US006115977A

United States Patent [19]

Hornberger et al.

[11] Patent Number: 6,115,977

[45] Date of Patent: Sep. 12, 2000

[54] KNOCK-DOWN PANEL PARTITION SYSTEM

[75] Inventors: Timothy G. Hornberger, Green Bay; Jon W. Gayhart, DePere; Andrew W. Mansfield; Yung Tse, both of Green Bay, all of Wis.

[73] Assignee: Krueger International, Inc., Green Bay, Wis.

[21] Appl. No.: 09/151,417

[22] Filed: Sep. 11, 1998

[51] Int. Cl.[7] ..... E04H 1/00

[52] U.S. Cl. ..... 52/238.1; 52/239; 52/489.1; 52/762; 52/764; 52/775

[58] Field of Search ..... 52/238.1, 239, 52/489.1, 489.2, 762, 764, 771, 775, 777

[56] References Cited

U.S. PATENT DOCUMENTS

| | | |
|---|---|---|
| Re. 32,890 | 3/1989 | DeFouw et al. . |
| 2,142,005 | 12/1938 | Roberts . |
| 2,175,717 | 10/1939 | Kerr . |
| 2,970,677 | 2/1961 | Springs, Jr. et al. . |
| 3,101,817 | 8/1963 | Radek . |
| 3,229,435 | 1/1966 | Olsen . |
| 3,312,025 | 4/1967 | Deakins . |
| 3,327,440 | 6/1967 | Watkins . |
| 3,349,535 | 10/1967 | Balinski . |
| 4,296,579 | 10/1981 | Proud . |
| 4,438,614 | 3/1984 | Raith et al. . |
| 4,567,698 | 2/1986 | Morrison . |
| 4,571,907 | 2/1986 | DeFouw et al. . |
| 4,593,508 | 6/1986 | Curatolo . |
| 4,631,881 | 12/1986 | Charman . |
| 4,716,699 | 1/1988 | Crossman et al. . |
| 4,905,334 | 3/1990 | Oppenhuizen . |
| 4,905,428 | 3/1990 | Sykes . |
| 4,949,519 | 8/1990 | Jeffers . |
| 4,996,811 | 3/1991 | Dull et al. . |
| 5,005,325 | 4/1991 | Dull et al. . |
| 5,033,526 | 7/1991 | DeLong et al. . |
| 5,054,255 | 10/1991 | Maninfior . |
| 5,056,577 | 10/1991 | DeLong et al. . |
| 5,058,347 | 10/1991 | Schuelke et al. . |
| 5,069,263 | 12/1991 | Edwards . |
| 5,088,541 | 2/1992 | Persing et al. . |
| 5,092,385 | 3/1992 | Beaulieu . |
| 5,092,786 | 3/1992 | Juhlin et al. . |
| 5,097,643 | 3/1992 | Wittler . |

(List continued on next page.)

FOREIGN PATENT DOCUMENTS

| | | |
|---|---|---|
| 1233616 | 3/1988 | Canada . |
| 0050241 | 4/1982 | European Pat. Off. . |
| 0479331 | 4/1992 | European Pat. Off. . |
| 0557092 | 8/1993 | European Pat. Off. . |
| 0867574 | 9/1998 | European Pat. Off. . |
| 2081767 | 2/1982 | United Kingdom . |
| 2323027 | 9/1998 | United Kingdom . |
| WO 93/22518 | 11/1993 | WIPO . |
| WO 98/28503 | 7/1998 | WIPO . |

*Primary Examiner*—Christopher T. Kent
*Assistant Examiner*—Jennifer I. Thissell
*Attorney, Agent, or Firm*—Andrus, Sceales, Starke & Sawall

[57] ABSTRACT

A space dividing or partitioning system includes a series of panels adapted to be knocked down and reconfigured. Each panel includes a panel frame constructed from a pair of vertical posts interconnected by one or more horizontal support members. Each vertical post includes a series of receptacles aligned vertically along each face surface of the vertical post. The receptacles on the vertical posts receive attachment members contained on each end of the horizontal support member. The horizontal support member can be attached between a pair of the vertical posts without requiring the vertical posts to be separated. A tile retaining hook is received within a hook opening formed in the vertical post. The tile retaining hook includes a hook portion that is received in a hook channel of a decorative tile, such that the decorative tile can be hung on the panel frame through the use of the tile retaining hooks. A base cover is attached to the bottom horizontal support member to create a wireway passing beneath the interconnected panel frames. Electrical hanging brackets connect a rigid wireway to the lower horizontal support member.

18 Claims, 23 Drawing Sheets

U.S. PATENT DOCUMENTS 5,117,599 6/1992 Voss .
5,134,826 8/1992 LaRoche et al. .
5,155,955 10/1992 Ball et al. .
5,160,188 11/1992 Rorke et al. .
5,187,908 2/1993 Losensky .
5,214,889 6/1993 Nienhuis et al. .
5,323,695 6/1994 Borgman et al. .
5,328,260 7/1994 Beirise .
5,341,615 8/1994 Hodges et al. ..... 52/220.7
5,377,466 1/1995 Insalaco et al. .
5,394,668 3/1995 Lim .
5,487,246 1/1996 Hodges et al. .
5,638,650 6/1997 Edwards .

FIG. 15
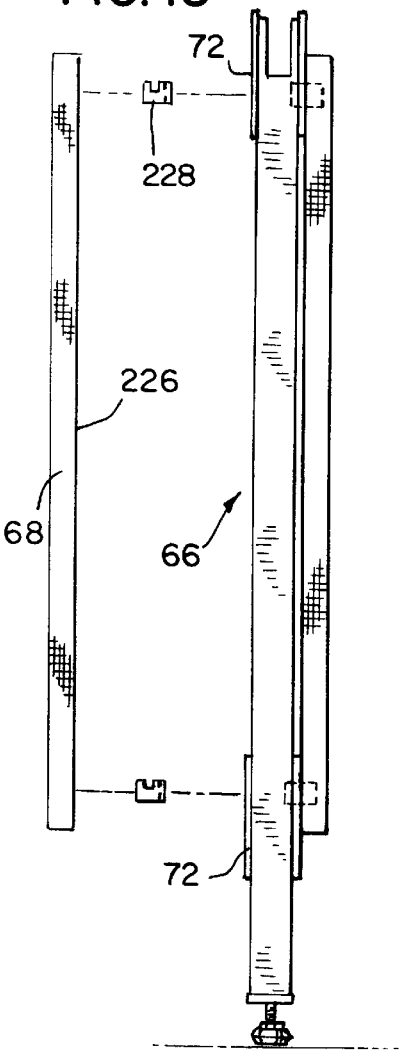
FIG. 14
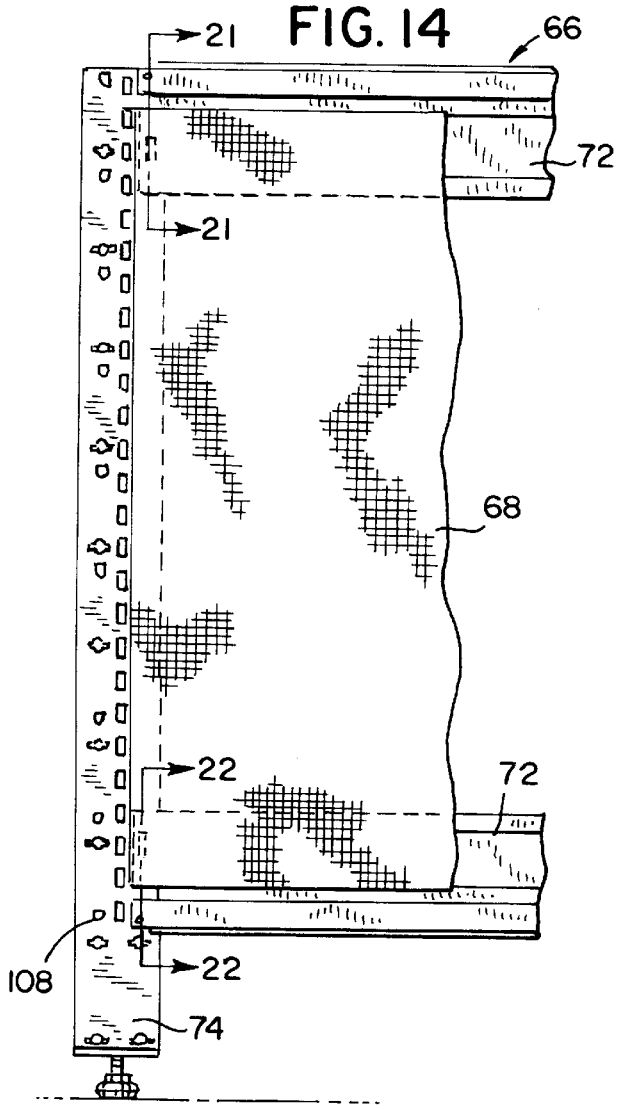
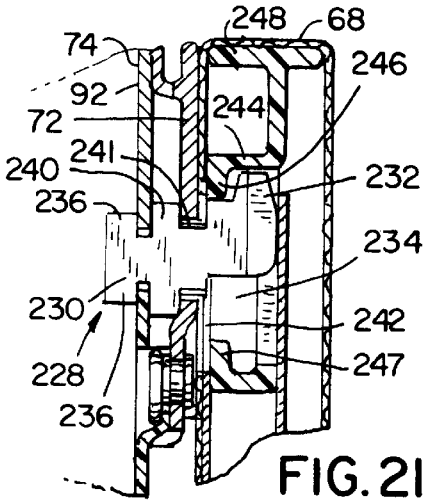
FIG. 21
FIG. 22
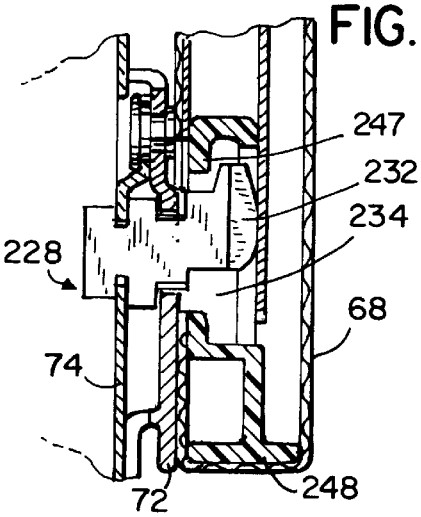

FIG. 28
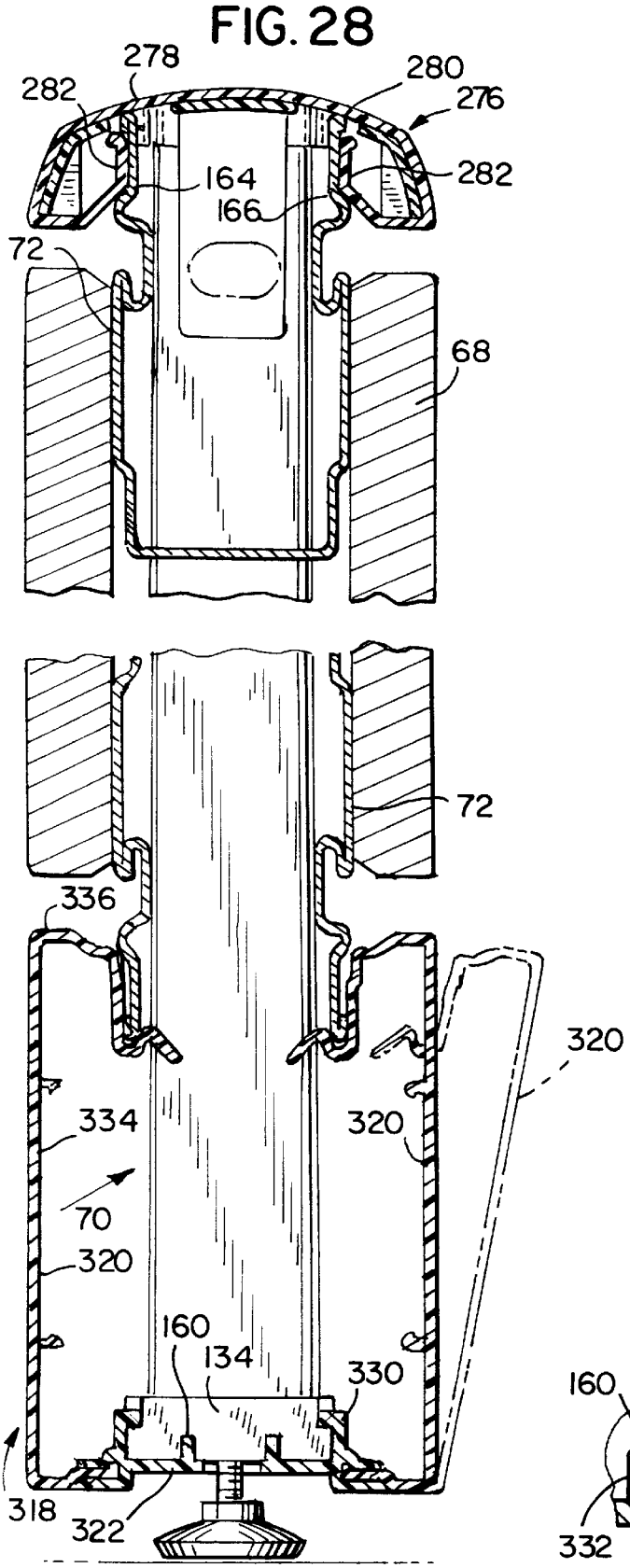
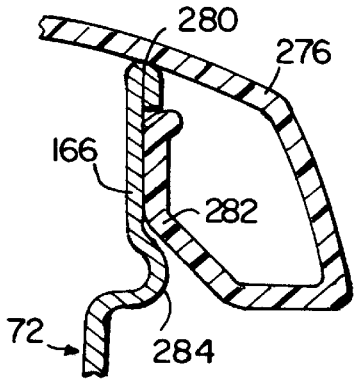
FIG. 28A
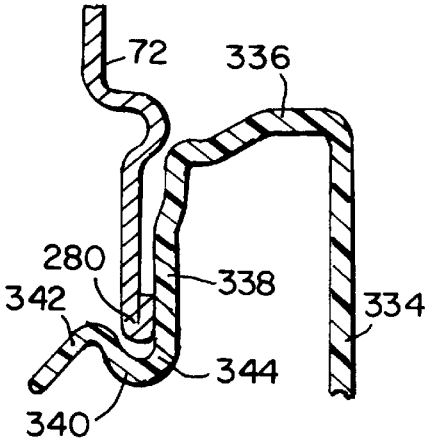
FIG. 28B
FIG. 28C
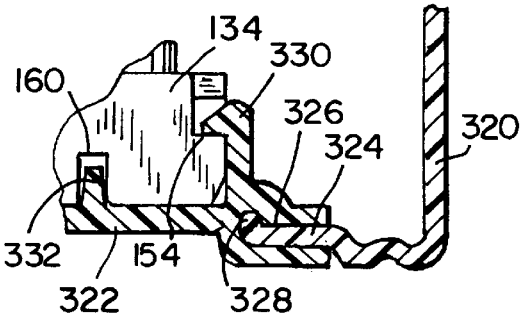

FIG. 44
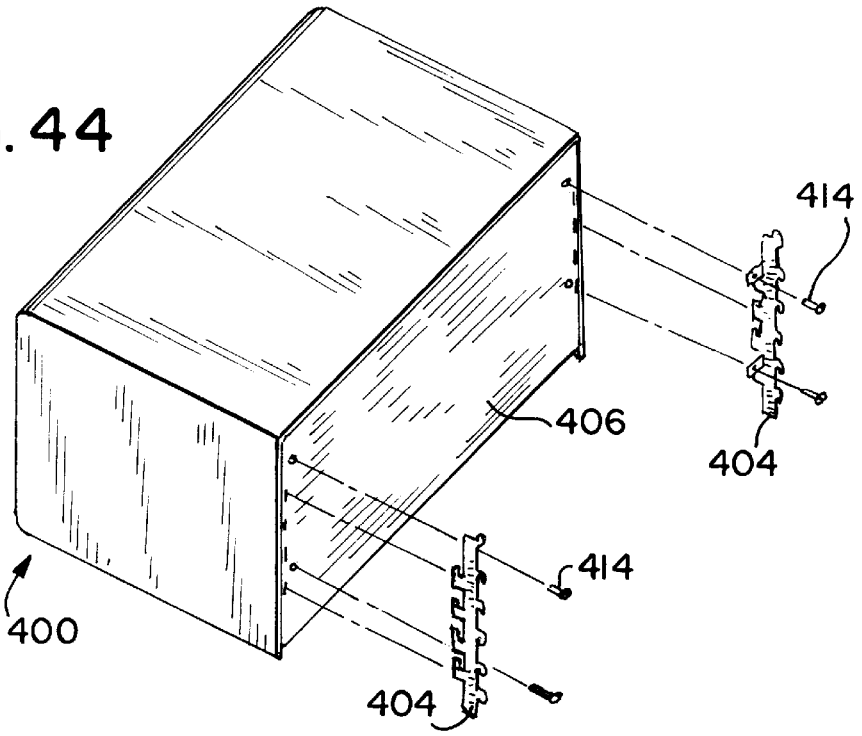
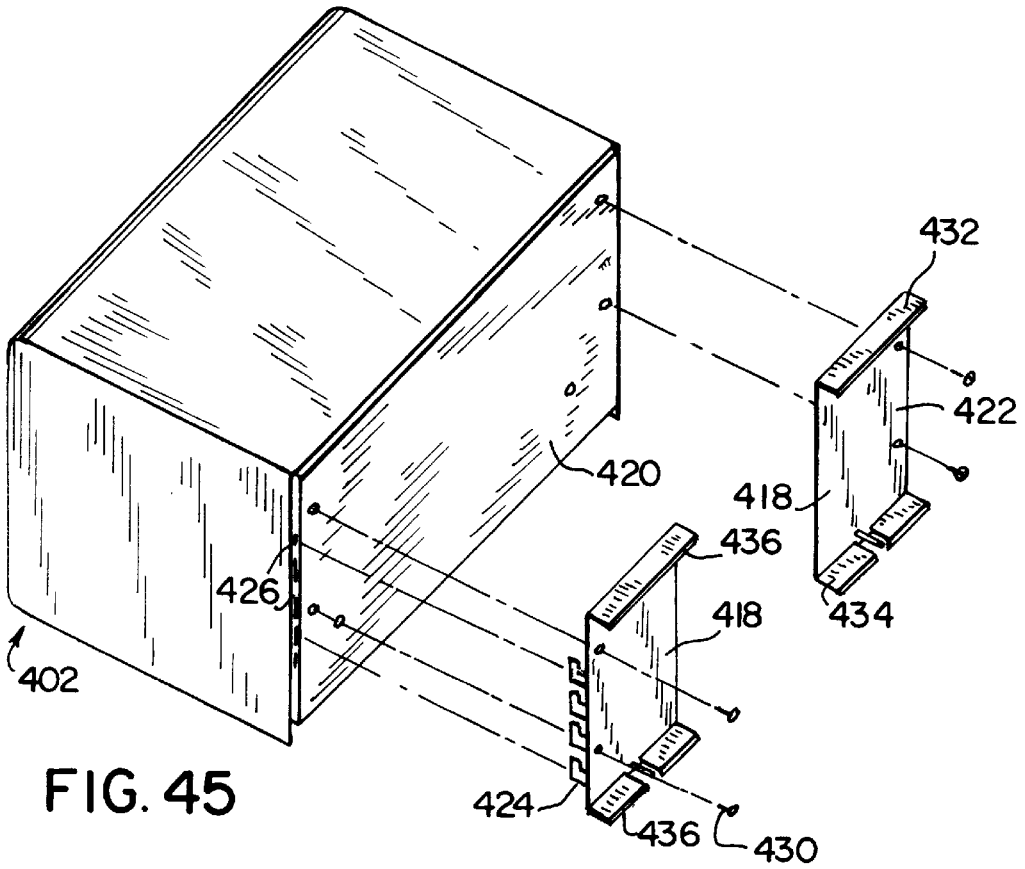
FIG. 45

FIG. 48
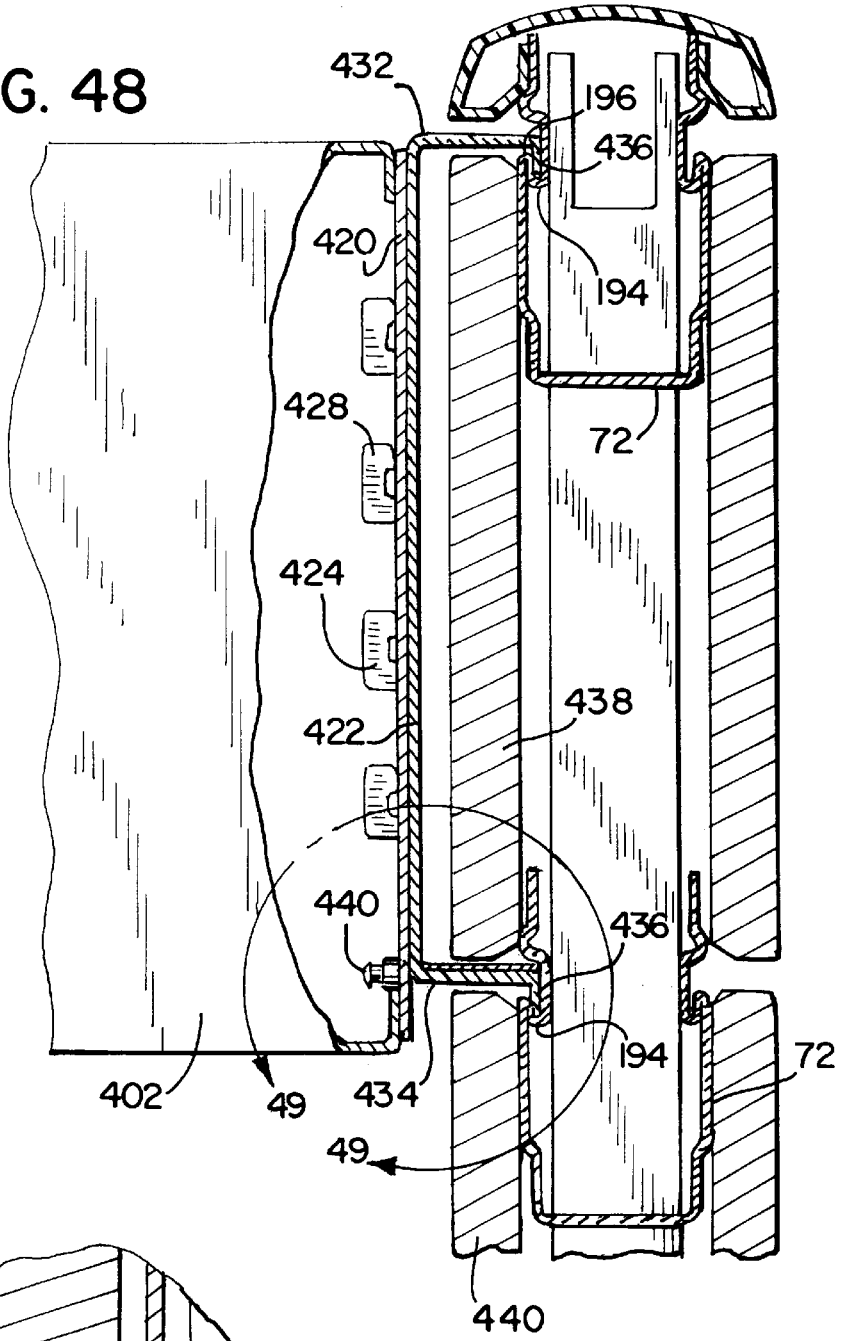
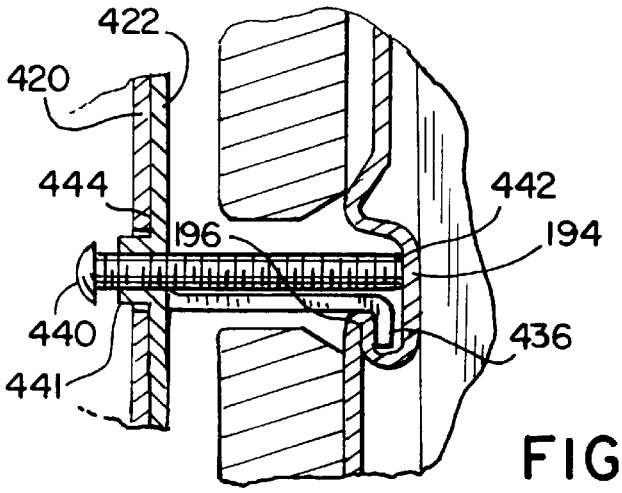
FIG. 49

FIG. 51
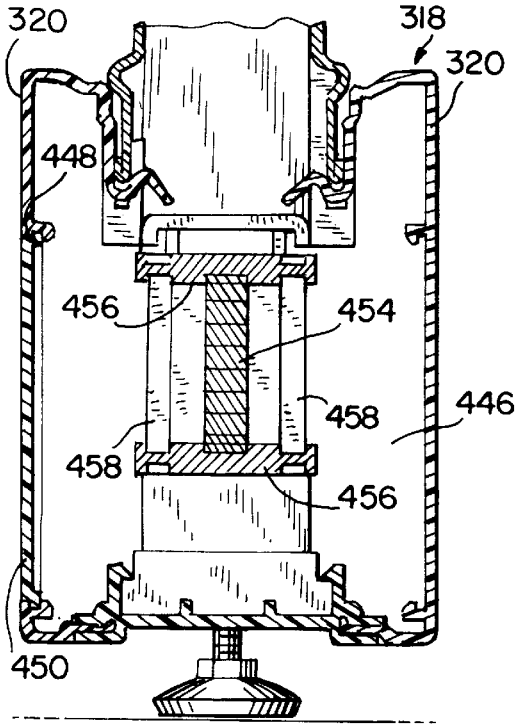
FIG. 52
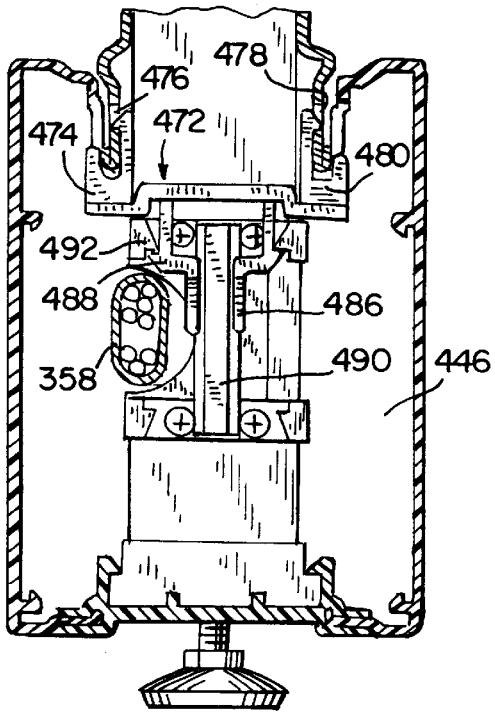
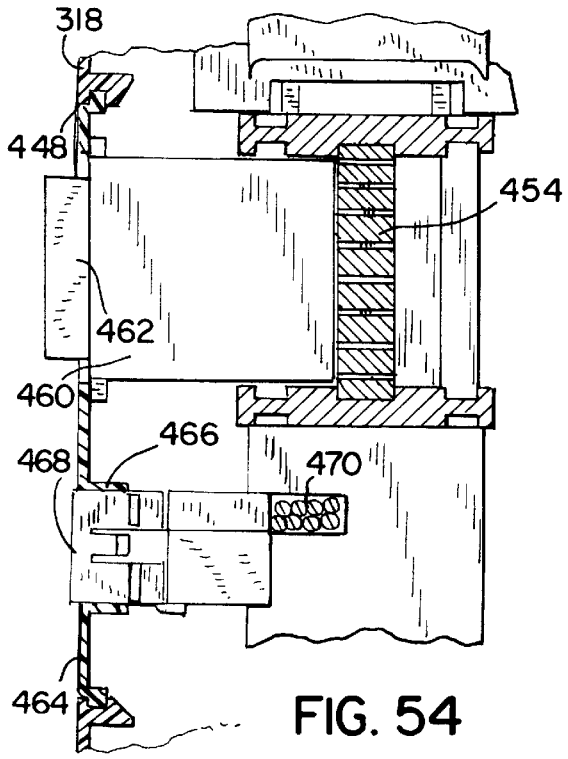
FIG. 54
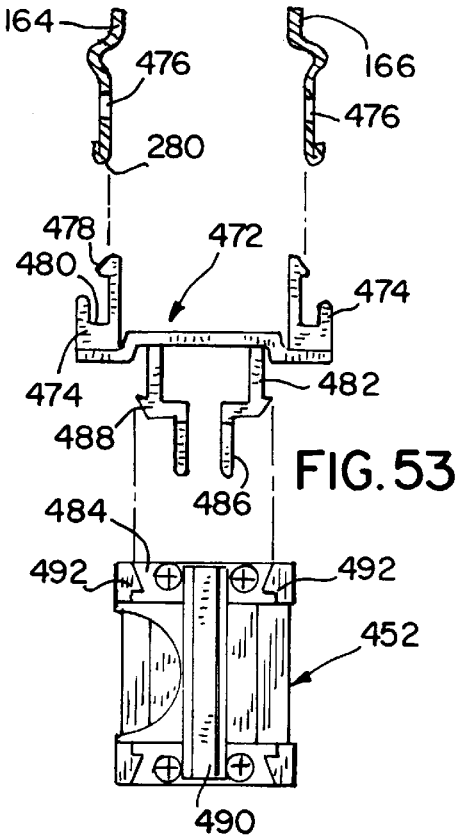
FIG. 53

KNOCK-DOWN PANEL PARTITION SYSTEM

BACKGROUND AND SUMMARY OF THE INVENTION

The present invention relates to a space dividing or partitioning system, such as for use in an office environment. More specifically, the invention relates to such a system that can be easily assembled and disassembled providing numerous space dividing configurations.

A wide variety of office space partitioning or dividing systems are known. Many such systems include individual pre-assembled wall panels that are rigidly interconnected to each other to form a sectioned wall assembly. A pre-assembled panel typically includes a factory assembled panel frame that receives a decorative tile. The decorative tile typically includes a hook member extending from its back face surface that is received in a notched opening in the panel frame. The hook members on each of the tiles allow the tile to be hung from the panel frame. In such a system, it is common to provide a power distribution system toward the lower end of each wall panel, incorporating power receptacles at spaced locations. It is also known to provide power and/or communication distribution in each panel substantially at desk height.

While this type of wall construction functions well and has met with success, it involves certain drawbacks. For example, since each of the decorative tiles includes a hook member extending from its back face surface, care is required in storage and transportation of the individual tiles so as not to bend the hook members on the decorative tile. Further, the space occupied by the hook members prevents the tiles from being efficiently stacked for shipment or storage, and the tiles must be protected to prevent damage which maybe caused by the hook members when the tiles are stacked. Additionally, since the panel frames are typically pre-constructed, if the office owner wishes to reconfigure the panel system, additional panels having the desired configuration must either be retrieved from storage or ordered from the panel manufacturer.

Field-installed panel systems have been developed to overcome certain limitations of wall systems based on prefabricated panel frames. These systems generally include posts and horizontal support members which are selectively engageable with the posts. The posts and horizontal support members are assembled together to construct the skeleton of a wall, and tiles are engaged with the posts to form a wall system. In known systems of this type, however, a module defined by a pair of posts and horizontal support members interconnected therebetween cannot be reconfigured, such as by changing the location of the horizontal support members, without disassembling the entire module. In these systems, if the office owner wishes to add additional horizontal support members to the panel frame or alter the location of existing horizontal support members, the panel frame must be disassembled and the vertical uprights separated to permit the positioning of the horizontal support member therebetween.

It is an object of the present invention to provide a space dividing or partitioning system incorporating field-assembled panel frames. It is a further object of the invention to provide such a system that includes horizontal support members attached between spaced vertical posts, where the horizontal support members can be attached to the vertical posts without separation of the vertical posts. Another object of the invention is to provide such a system that can be quickly and easily reconfigured with a minimal amount of labor. Yet another object of the invention is to provide such a system that can be constructed from a minimal number of core components, such that storage space for the components when not in use is minimized. A still further object of the invention is to provide such a system in which the decorative tiles are hung to each panel frame by independent tile retaining hooks not permanently attached to either the tile or the panel frame. Yet another object of the invention is to provide a tile frame for each of the decorative tiles that can be assembled from individual tile frame members welded at overlapping locations. A still further object of the invention is to provide such a system including horizontal support members that can be attached between the vertical posts in either an upright or an inverted manner. Yet another object of the invention is to provide a novel method of mounting power and data communication wires beneath the individual panels. Yet another object of the invention is to provide a space dividing or partitioning system that can be assembled and disassembled into numerous configurations, including half wall, full wall, and "off-module" mounted walls. A further object of the invention is to provide an overhead storage member that can be slidably mounted within a channel formed in each of the horizontal support members, such that the overhead storage member can be mounted "off-module" and slid between adjacent panel frames.

Generally, the invention contemplates a space dividing or partitioning system for use in a building having a floor and a ceiling. The space dividing system of the invention includes a series of interconnected wall modules or panels, each formed from a field-assembled panel frame and one or more decorative tiles hung on the panel frame. Each panel frame is formed from a pair of vertical posts and at least one horizontal support member positioned between the vertical posts. The vertical posts are configured such that each post is common to adjacent wall modules or panels. Each vertical post may be formed from one or more post sections interconnected by a splice section. The post sections may be either a half post section or a full post section.

Each of the half post sections and full post sections includes a series of vertically aligned receptacles extending from their front and rear face surfaces. The receptacles are spaced and sized to receive attachment members contained on each end of the horizontal support member.

Each horizontal support member defines opposed first and second ends, and is formed from a bottom wall and a pair of opposed sidewalls. The bottom wall of each horizontal support member includes a pair of cut-outs extending from both the first end and the second end of the horizontal support member. The cut-outs allow the horizontal support member to be mounted between a pair of vertical posts that are spaced apart a distance less than the length of the horizontal support member without first separating the vertical posts.

In accordance with another aspect of the invention, a tile retaining hook is inserted into a hook opening formed in the panel frame. The tile retaining hook extends from the panel frame and is received within a hook channel formed in the decorative tile to be hung on the panel frame. The tile includes a pair of hook channels formed on each corner that extend at a 90° angle with respect to each other. The tile can thus be mounted to the panel frame either vertically or horizontally, depending upon the user's requirements.

In accordance with yet another aspect of the invention, a horizontal support member is inverted and mounted near the bottom end of the panel frame. The inverted horizontal support member provides the required support for an electric wireway extending between adjacent joined panels.

In accordance with yet another aspect of the invention, each horizontal support member is configured to provide access to openings contained on the vertical post when the horizontal support member is mounted between a pair of vertical posts. An opening formed in the horizontal support member is alignable with an opening formed on the vertical post when the horizontal support member is mounted to the vertical post. A tile retaining hook extends through the aligned openings and functions to interlock an end of the horizontal support member with the vertical post. Additionally, proper alignment of the opening in the horizontal support member and the opening in the vertical post ensures proper construction of the panel frame.

In accordance with another aspect of the invention, a base cover is mounted below the inverted lower horizontal support member to provide a cover for the wireways mounted to the series of interconnected panels. Each base cover includes a lower wall and a pair of base sides that engage the lower horizontal support member. The base cover can be opened to provide access to the wireway.

In accordance with yet another aspect of the invention, the electric wireway includes a series of rigid wireways joined by electric wire connectors. The rigid wireways are each supported below the inverted lower horizontal support member by electrical hanging brackets that engage the rigid wireway and the inverted lower support member.

In accordance with a further aspect of the invention, the tiles are constructed from a series of frame members each joined by a corner connector. The corner connector is received within a channel formed in each frame member. Each frame member includes an attachment flange extending from the channel. When the tile frame is assembled, a raised portion of each attachment flange overlaps a portion of the adjacent attachment flange, such that the adjacent attachment flanges can be spot welded to securely form the tile frame.

In accordance with yet another aspect of the invention, the space dividing or partitioning system of the invention can be field-assembled from a minimal number of separate components. In particular, each of the vertical posts is constructed from joined vertical post sections. The height of each vertical post is determined by the number of vertical post sections selected. Each of the vertical post sections are joined by a splice section received within the hollow interior of each post section. Once the vertical posts have been assembled, the horizontal support members are attached at the desired locations along each of the vertical posts to form a panel frame. Since each vertical post includes a series of regularly spaced receptacles extending along its length, the horizontal support members can be attached between a pair of the vertical posts at user-selected locations.

In accordance with a further aspect of the invention, an overhead storage member is provided that can be mounted between a pair of adjacent panels. The overhead storage member includes a mounting arrangement that is slidably received in a channel formed in a sidewall of the horizontal support member. The mounting arrangement includes a support flange that extends from a back wall of the overhead storage member and is received in the channel. The support flange can slide between the horizontal support members contained on adjacent panel frames such that the overhead storage member can be mounted in any location relative to the panels, including "off-module" mounting.

In accordance with a further aspect of the invention, an intermediate horizontal support member can be inserted into an assembled panel frame without disassembling the panel frame. Specifically, the horizontal support member can be inserted into the panel frame without first separating the vertical posts.

The various aspects of the invention can be employed separately or in sub-combinations as desired. In a particularly preferred form, however, all of the various aspects of the invention are incorporated in a space dividing or partitioning system to provide such a system having significant advantages in manufacture, installation and reconfiguration.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 14 is a partial front elevation view showing the mounting of a tile to the panel frame of FIG. 2;

FIG. 15 is an exploded side elevation view showing the mounting of the tile to the panel frame;

FIG. 21 is an enlarged partial section view taken along line 21—21 of FIG. 14 illustrating the function of the tile retaining hook;

FIG. 22 is an enlarged partial section view taken along line 22—22 of FIG. 14 illustrating the function of the tile retaining hook;

FIG. 28 is a partial section view taken along line 28—28 of FIG. 25 illustrating the panel top cap and base cover;

FIG. 28*a* is an enlarged partial section view showing the interaction between the panel top cap and one of the horizontal support members;

FIG. 28*b* is an enlarged partial section view illustrating the interaction between the base cover and one of the horizontal support members;

FIG. 28*c* is an enlarged partial section view illustrating the construction of the base cover;

FIG. 44 is an exploded isometric view showing the mounting arrangement for one of the overhead storage members of FIG. 43;

FIG. 45 is an exploded isometric view similar to FIG. 44, illustrating a second mounting arrangement for one of the overhead storage members;

FIG. 48 is a partial section view taken along line 48—48 of FIG. 43;

FIG. 49 is an enlarged partial section view of the area identified by line 49—49 of FIG. 48;

FIG. 51 is a partial section view taken along line 51—51 of FIG. 50*a;*

FIG. 52 is a partial section view taken along line 52—52 of FIG. 50*a;*

FIG. 53 is an exploded elevation view showing the interconnection between an electrical hanging bracket and the rigid wireway;

FIG. 54 is a partial section view taken along line 54—54 of FIG. 50*a;*

DETAILED DESCRIPTION OF THE INVENTION

Figure 1:
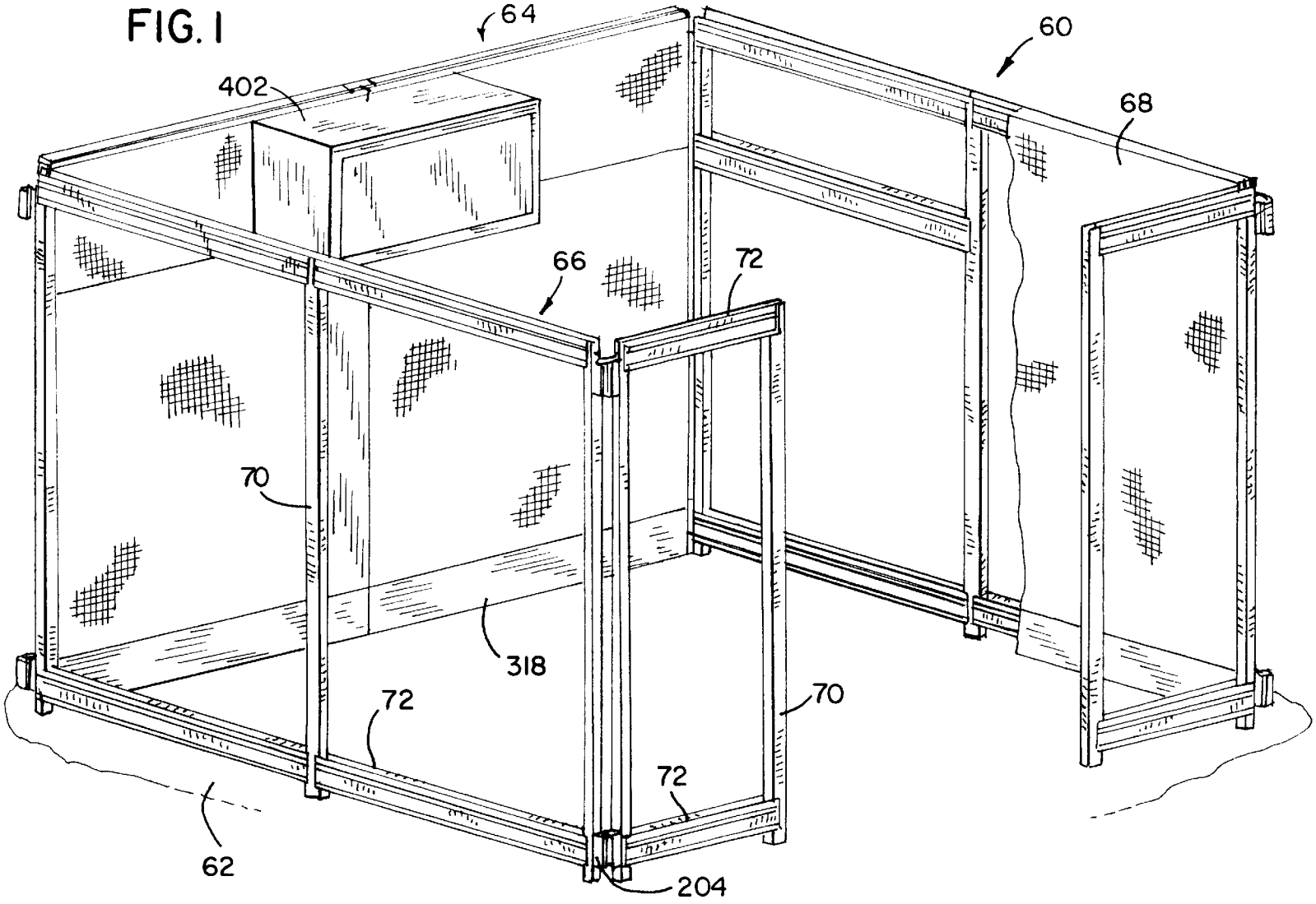
FIG. 1 is an isometric view illustrating a knock-down space dividing or partitioning system in accordance with the present invention.

FIG. 1 illustrates a space dividing or partitioning system 60 constructed in accordance with the present invention. Space dividing system 60 is adapted for use in a building having an open space between a floor 62 and a ceiling, and is operable to divide the open space into smaller areas. In particular, space dividing system 60 is adapted for use in a work place environment to divide the open space into individual work areas, meeting areas, reception areas or the like. Generally, space dividing system 60 includes a series of interconnected panels 64 that can be joined in numerous configurations to define the individual areas. Each of the panels 64 generally includes a field-assembled panel frame 66 and one or more decorative tiles 68 that are supported on the panel frame 66. The tiles 68 define the walls of the individual area and often include a decorative pattern.

Figure 2:
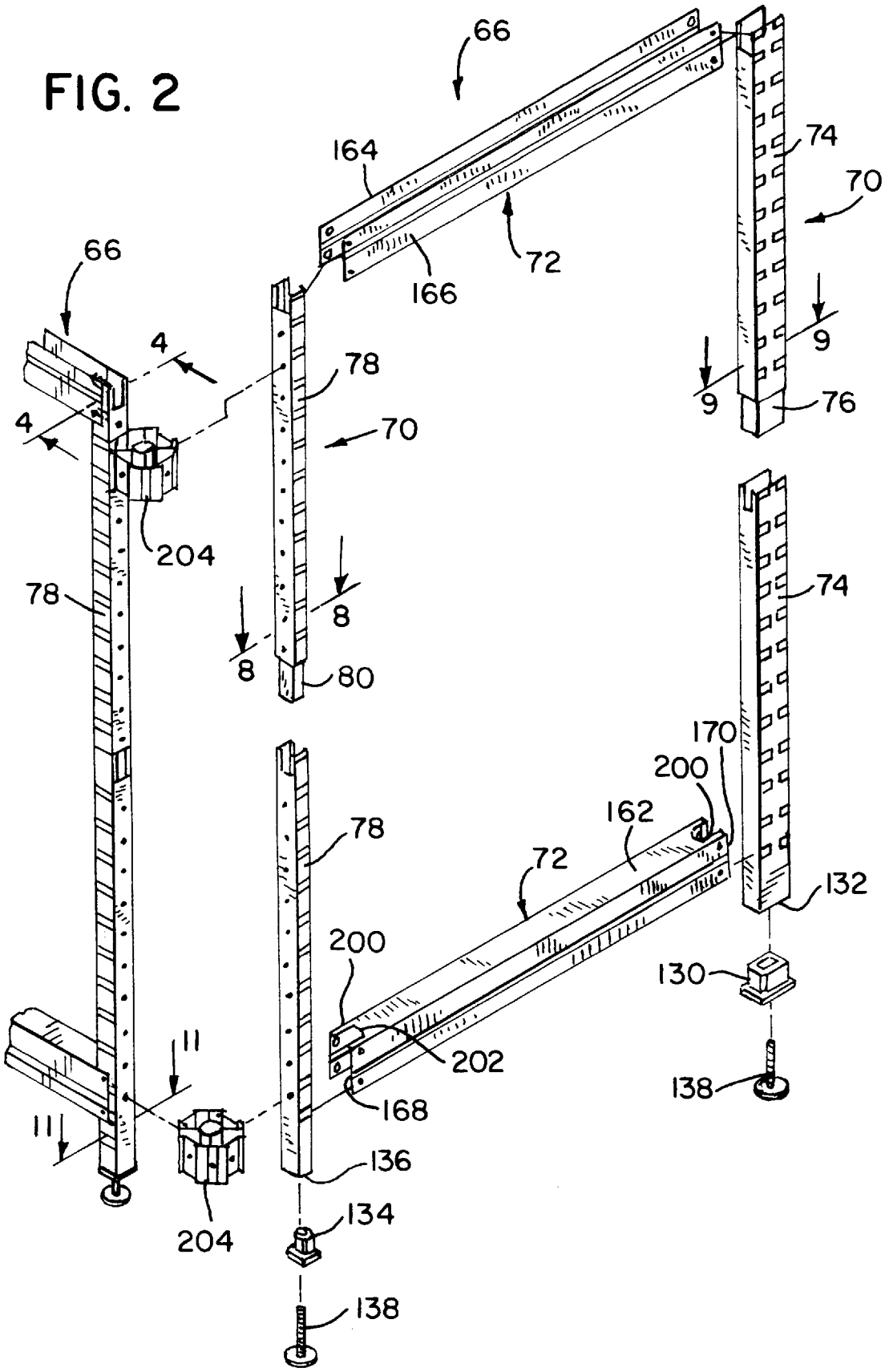
FIG. 2 is an exploded isometric view illustrating the construction of a panel frame for use in the space dividing or partitioning system of FIG. 1.

FIGS. 2–13 illustrate the construction of the panel frames 66. Referring first to FIG. 2, each panel frame 66 generally includes a pair of vertical posts 70 joined by at least one horizontal support member 72. In the embodiment shown, the panel frame 66 includes both an upper and a lower horizontal support member 72. The vertical posts 70 are spaced apart by the length of each horizontal support member 72, and the connection between the posts 70 and the horizontal support members 72 provides the required rigidity for the panel frame 66.

In order to provide a space dividing system 60 that can be assembled and disassembled to create individual areas having a variety of configurations, each of the vertical posts 70 shown in FIG. 2 may be constructed from a pair of individual post sections joined together by a splice section. In the panel frame 66 shown in FIG. 2, the right vertical post 70 is constructed from two full post sections 74 that are joined together by a splice section 76, while the left vertical post 70 is formed from a pair of half post sections 78 joined by a splice section 80. Alternatively, each vertical post 70 may be continuous and formed without splices.

Figure 9:
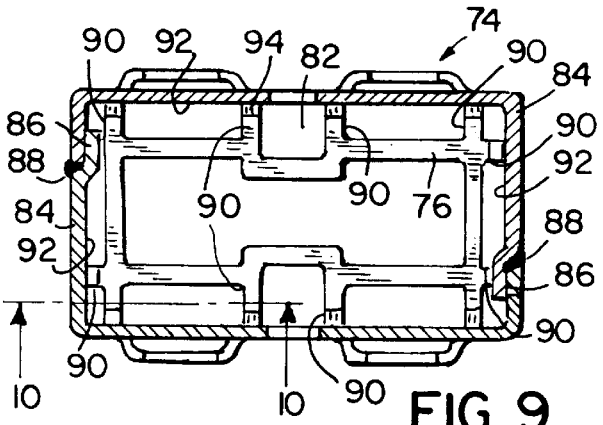
FIG. 9 is a section view taken along line 9—9 of FIG. 2.

As shown in FIG. 9, the splice section 76 is received within an open interior 82 defined by the outer walls of the full post section 74. Full post section 74 is formed from two identical mating outer wall sections 84 that define the generally rectangular open interior 82. The pair of identical outer wall sections 84 are joined along a pair of longitudinal seams 86 by a series of spaced welds 88. In the preferred embodiment of the invention, each of the outer wall sections 84 forming the full post section 74 is formed from sixteen gauge cold rolled steel to provide the required strength and rigidity for the panel frame 66.

Figure 10:
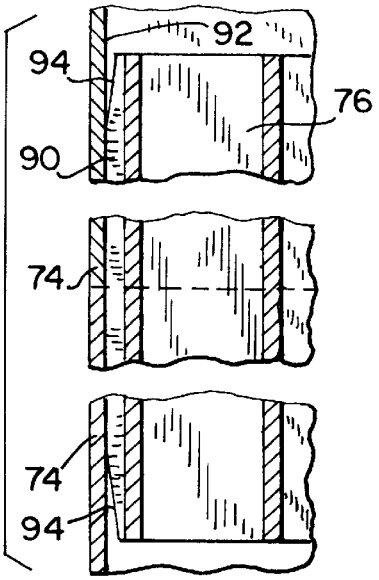
FIG. 10 is a partial section view taken along line 10—10 of FIG. 9.

As can be seen in FIGS. 9 and 10, the splice section 76 includes a series of web sections 90 that extend outward and create an interference fit with inner surfaces 92 of the full post section 74. Each web section 90 includes a tapered portion 94 that allows the splice section 76 to be inserted into the open interior 82 of the full post section 74. As shown in FIGS. 2 and 10, the splice section 76 is positioned between the upper and lower full post sections 74 such that the splice section 76 securely connects the upper and lower full post sections 74 to generally define the complete vertical post 70 to be utilized in the panel frame 66. Constructing each vertical post 70 from two separate full post sections 74 allows the panel frame 66 to be constructed having either the full height as shown, or a reduced height if only one full post section 74 is used.

Figure 8:
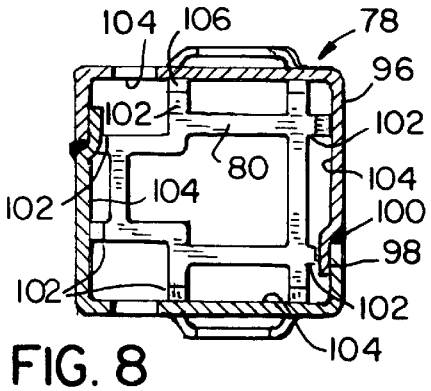
FIG. 8 is a section view taken along line 8—8 of FIG. 2.

Referring now to FIG. 8, the half post section 78 is constructed in a similar manner to the full post section 74 previously discussed. However, the width of the half post section 78 is approximately half the width of the full post section 74. In construction of the panel frame 66, the full post sections 74 are used to form the vertical post 70 between adjacent panels extending in the same direction, while the half post sections 78 are utilized to form a vertical post 70 at end of run locations, such as where adjacent panel frames 66 extend at a 90° angle with respect to each other, as shown in FIG. 2. The half post section 78 is constructed from a pair of outer wall sections 96 that are joined along a longitudinal seam 98 by a series of welds 100. Splice section 80 includes a series of web sections 102 that extend outward and create an interference fit with inner surfaces 104 of the half post section 78. Tapered portions 106 of each web section 102 allow the splice section 80 to be inserted between the upper and lower half post sections 78, such that the left complete vertical post 70 can be constructed as shown in FIG. 2.

Figure 3:
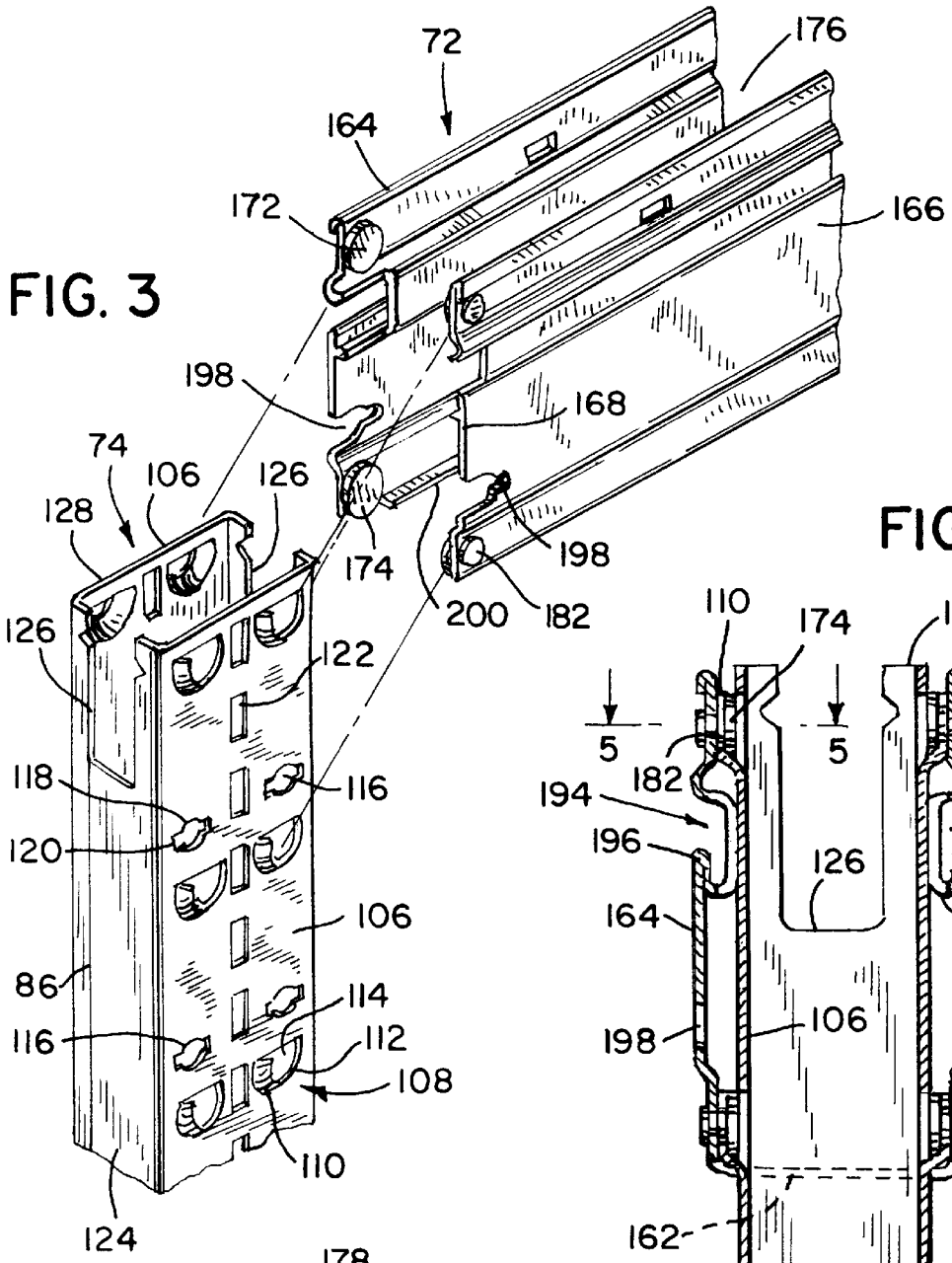
FIG. 3 is an enlarged partial exploded isometric view showing the connection between a vertical post and horizontal support member of the panel frame of FIG. 2.
Figure 7:
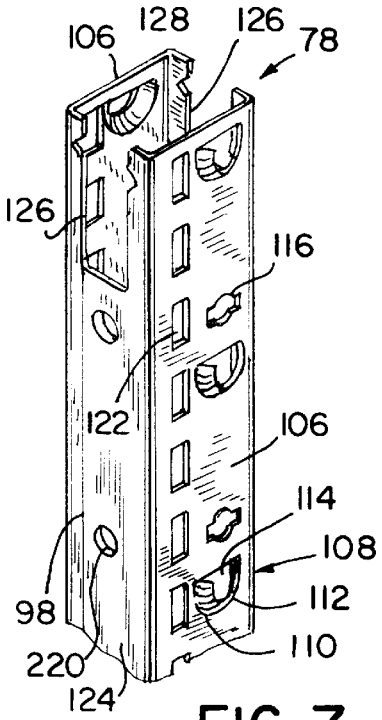
FIG. 7 is a partial isometric view illustrating the upper end of a vertical half post section of the panel frame of FIG. 2.

Referring now to FIGS. 3 and 7, the full post section 74 and the half post section 78 will now be described, with the understanding that like features on each will be identified by corresponding reference numerals to facilitate understanding. However, as the figures clearly illustrate, the half post section 78 is approximately half the width of the full post section 74. Both the full post section 74 and the half post section 78 include a pair of face surfaces 106. Since both the full post section 74 and the half post section 78 are constructed from identical outer wall sections 84 and 96, respectively, both face surfaces 106 are identical. Each face surface 106 includes a series of formed-out receptacles 108. The receptacles 108 each include a curved retaining flange 110 that extends outward from the otherwise flat face surface 106, as can best be seen in FIG. 4. The retaining flange 110 includes a curved edge 112 spaced a predetermined distance from the face surface 106, for reasons that will be discussed in detail below. The receptacles 108 each extend outwardly of an opening 114 which communicates with the open interior 82 of the full post section 74.

As can be seen in both FIGS. 3 and 7, the receptacles 108 are spaced vertically along the entire length of either the full post section 74 or the half post section 78. Representatively, the vertical spacing between the receptacles 108 may be approximately 3 inches. In the full post section 74 shown in FIG. 3, a second series of receptacles 108 are positioned directly adjacent to the first series of receptacles 108. The two series of receptacles 108 allow the full post section 74 to receive two separate horizontal support members 72 in a manner to be discussed in greater detail below.

Positioned directly above each of the receptacles 108 is a hook opening 116. The hook openings 116 are formed in each of the face surfaces 106 and provide access to the interior of the full post section 74 or half post section 78. Each hook opening 116 includes a substantially circular main opening 118 and a pair of opposed notches 120 each extending horizontally from the main opening 118. Like the receptacles 108, the hook openings 116 may be spaced approximately 3 inches apart along the length of both the full post section 74 and the half post section 78. The full post section 74 includes two sets of hook openings 116 extending along the entire length of the full post section 74, as with the receptacles 108.

A series of aligned support slots 122 are positioned between the two vertical rows of receptacles 108 on the full post section 74 of FIG. 3. The support slots 122 extend at regular intervals along the entire length of the full post section 74 and provide a point of attachment for various components of the space dividing system 60, as will be discussed in greater detail below. The half post section 78 shown in FIG. 7 includes a vertical row of support slots 122 positioned adjacent the vertical row of receptacles 108. Like the support slots 122 formed on the full post section 74, the support slots 122 on the half post section 78 also provide a point of attachment for other components, as will be discussed in greater detail below. Representatively, the center-to-center spacing of support slots 122 may be approximately 1 inch.

In addition to the pair of face surfaces 106, both the full post section 74 and the half post section 78 include a pair of opposed side edge surfaces 124. Each of the edge surfaces 124 includes the seam 86 or 98 joining the outer wall sections 84 or 96 to form both the full post section 74 and half post section 78. A pair of aligned access notches 126 are formed in each edge surface 124 of both the full post section 74 and the half post section 78. Each access notch 126 opens from a top end 128 of either the full post section 74 or half post section 78. The access notches 126 provide an access passageway through the full post section 74 or half post section 78. In this manner, the access notches 126 allow items, such as electrical or communication wires, to pass through the full post section 74 or half post section 78 in a manner that will be discussed in greater detail below.

Referring back to FIG. 2, the lowermost full post section 74 receives a glide housing 130 inserted into its bottom end 132, while the lowermost half post section 78 receives a similar glide housing 134 also inserted into its bottom end 136. Each of the glide housings 130 and 134 receive a glide member 138 that engages floor 62, which can be adjusted to provide balanced support for the panel frame 66.

Figure 11:
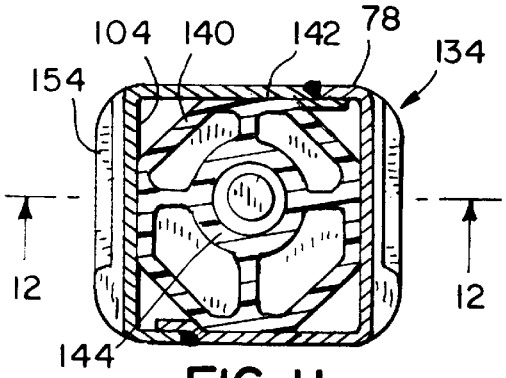
FIG. 11 is a section view taken along line 11—11 of FIG. 2.
Figure 12:
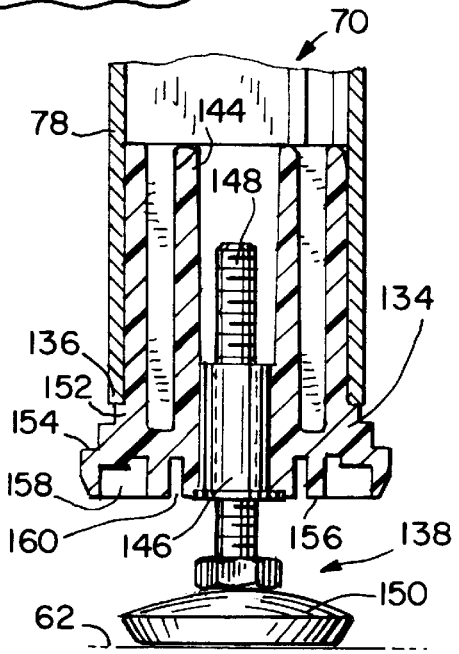
FIG. 12 is a partial section view taken along line 12—12 of FIG. 11.

As can be seen in FIGS. 11 and 12, the glide housing 134 includes a series of webs 140 that define a series of flat contact surfaces 142. The contact surfaces 142 contact and engage inner surfaces 104 of the half post section 78 and create a friction fit to hold the glide housing 134 in place.

A center web 144 surrounds and holds an internally threaded sleeve 146 as shown in FIG. 12. The internally threaded sleeve 146 receives a threaded shank 148 of the glide member 138. The threaded shank 148 is connected to a castor 150, to provide support for the vertical post 70 on the floor 62. As can be understood in FIG. 12, the castor 150 can be adjusted vertically by screwing the threaded shank 148 into and out of the sleeve 146 in a conventional manner as is known.

The glide housing 134 includes a first shoulder 152 that contacts the bottom end 136 of the half post section 78 to fix the position of the glide housing 134 within the hollow half post section 78. In addition to the first shoulder 152, the glide housing 134 includes a second shoulder 154 that extends outward past the half post section 78. Additionally, a bottom edge 156 of the glide housing 134 includes an outer recess 158 and an inner notch 160. Recess 158 and notch 160, as well as shoulder 154, provide points of attachment for various panel trim components, as will be discussed in greater detail below. Although a description of only glide housing 134 has been provided, the glide housing 130 positioned in the full post section 74 has generally the same construction.

Figure 4:
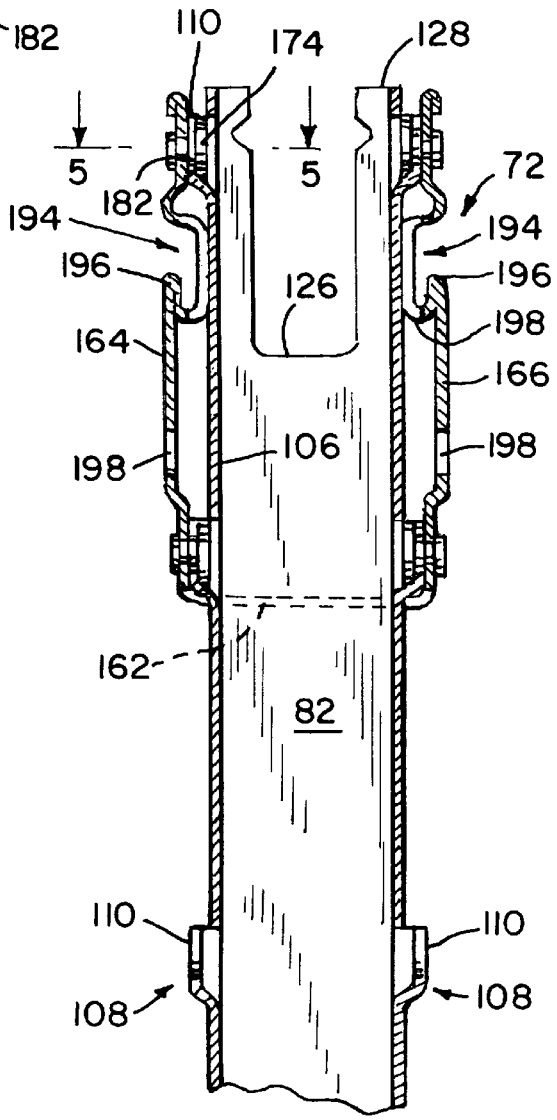
FIG. 4 is a section view taken along line 4—4 of FIG. 2.
Figure 5:
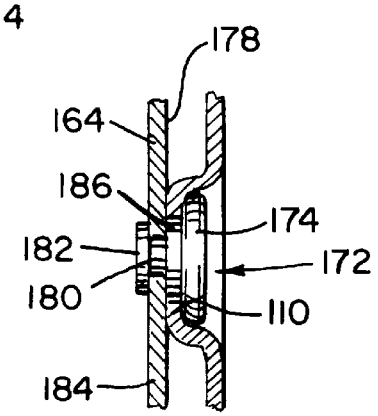
FIG. 5 is a partial enlarged section view taken along line 5—5 of FIG. 4.
Figure 6:
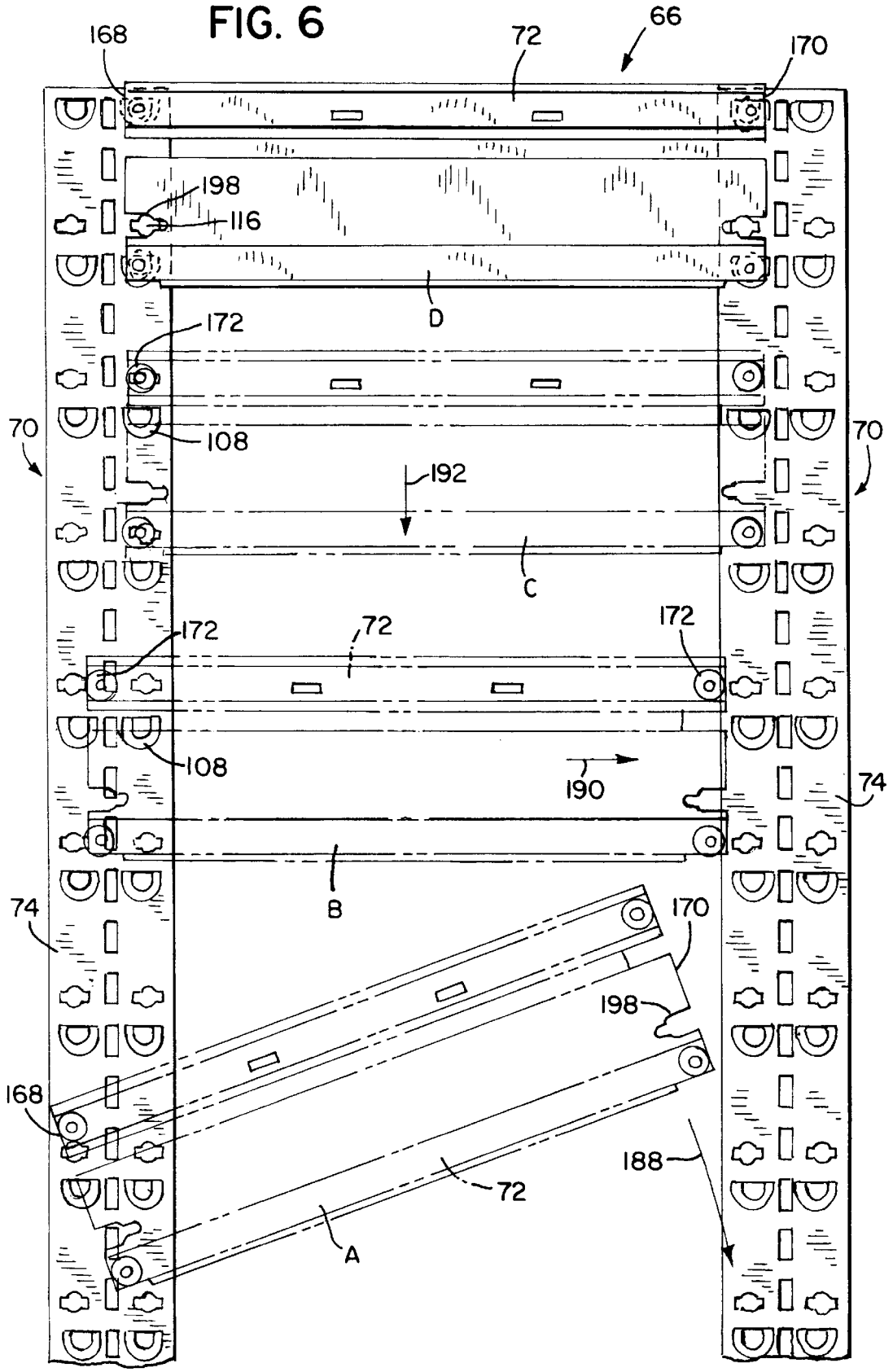
FIG. 6 is an elevation view of a pair of vertical posts and showing in phantom the steps performed in attaching a horizontal support member between the pair of vertical posts.

Referring now to FIGS. 2–6, each horizontal support member 72 has a general U-shaped cross-section defined by a bottom wall 162 and a pair of opposed sidewalls 164 and 166, as best shown in FIG. 4. The horizontal support member 72 generally extends longitudinally between a first end 168 and a second end 170, as shown in FIG. 6. As can be seen in FIG. 6, the first end 168 and the second end 170 are identical, such that the horizontal support member 72 can be attached between the pair of vertical posts 70 with either the sidewall 164 or the sidewall 166 facing outward.

As seen in FIGS. 3 and 4, the sidewalls 164 and 166 are spaced from each other by a distance sufficient to receive the full post section 74 or the half post section 78 therebetween. As illustrated in FIG. 3, the first end 168 of both the sidewall 164 and the sidewall 166 includes a pair of attachment members 172. Representatively, the attachment members 172 are each a locking rivet having an expanded head portion 174 that extends from the sidewall 164 or 166 into an open interior 176 defined by the sidewalls 164, 166 and the bottom wall 162. As can be seen in FIG. 5, the expanded head portion 174 extends from an inner face 178 of the sidewall 164. A shaft 180 extends through an opening in the sidewall 164 and is joined to an expanded end 182 that interacts with an outer face 184 of sidewall 162 to hold the attachment member 172 in place. In addition to the shaft 180, the attachment member 172 includes a standoff 186 that provides the desired spacing of the head portion 174 from the inner face 178.

As can be seen in FIGS. 4 and 5, the four attachment members 172 contained on the first end 168 of the horizontal support member 172 are spaced such that the four attachment members 172 are received within four corresponding receptacles 108 in the full post section 74. As can be understood in FIGS. 4 and 5, the head portion 174 of each attachment member 172 is received behind the retaining flange 110 and the standoff 186 contacts the curved edge 112 of the retaining flange 110. The horizontal support member 72 is held in place along the full post section 74 by an interference mechanical fit between the four receptacles 108 on the full post section 74 and the four attachment members 172 contained on the first end 168 of the horizontal support member 72.

Referring now to FIG. 6, the preferred method of installing the horizontal support member 72 between a pair of vertical posts 70 will now be described. Specifically, the method of installing the horizontal support member 72 between a pair of full post sections 74 will be described, although the same method would apply to the positioning of a horizontal support member 72 between a pair of half post sections 78 or a combination of a full post section 74 and a half post section 78.

Initially, as shown at position A, the horizontal support member 72 is positioned at an angle and moved between post sections 74 such that each post section 74 is located between sidewalls 164, 166 of horizontal support member 72. The attachment members 172 at the lower end (first end 168 in FIG. 6) are positioned above the set of receptacles 108 destined to receive the attachment members 172. Once the lower end (first end 168 in FIG. 6) of the horizontal support member 72 is in the desired location, the upper end (second end 170 in FIG. 6) is lowered as shown by arrow 188 to move the horizontal support member 72 to the position shown by reference character B. In position B, the attachment members 172 are positioned out of vertical alignment with the receptacles 108 into which they are to be inserted.

After the horizontal support member 72 is in position B, the horizontal support member 172 is moved laterally as indicated by arrow 190 until the attachment members 172 are vertically aligned slightly above the innermost receptacles 108, as shown by reference character C. Once the attachment members 172 have been properly aligned above the receptacles 108, the horizontal support member 72 is moved downward as indicated by arrow 192 until each attachment member 172 is initially received in a receptacle 108, as indicated by reference character D. The ends of horizontal support member 72 are then pounded downwardly, such as by use of a resilient mallet, to firmly seat each attachment member 172 in one of the receptacles 108. As horizontal support member 72 is pounded downwardly, each attachment member 172 is moved along the curved retaining flange 110, and the interference fit therebetween functions to draw the attachment members 172 on sidewalls 164 and 166 inwardly toward each other. This inward movement of attachment members 172 functions to pinch or clamp post section 74 between sidewalls 164, 166, to provide a secure mechanical, frictional engagement of horizontal support member 72 with post section 74.

It is important to note that the horizontal support member 72 can be positioned at numerous locations along the total height of the pair of vertical posts 70. Since the receptacles 108 are spaced at 3-inch intervals, the horizontal support member 72 can be placed at any 3-inch incremental height along the length of vertical posts 70. Additionally, it is also important to note that horizontal support member 72 can be positioned between the pair of vertical posts 70 without requiring the vertical posts 70 to be separated or any other movement of vertical posts 70. Thus, horizontal support members 72 can be added to or removed from the panel frame 66 after the panel frame 66 has been formed without first disassembling the panel frame 66, or the location of existing horizontal support members 72 can be changed. This feature is extremely important, since the panel frame 66 can be modified without being first disassembled.

Additionally, as can be seen in FIG. 2, the horizontal support member 72 positioned on the bottom of the panel frame 66 can be inverted relative to the horizontal support member 72 positioned at the top end of panel frame 66. The lower horizontal support member 72 is inverted such that it can support an electric wireway, in a manner to be discussed in greater detail below. However, it should be noted that the spacing between the lowermost receptacles 108 is increased relative to the spacing between the remaining receptacles 108 in order to accommodate the inversion of the horizontal support member 72 near the bottom of the panel frame 66.

Referring now to FIGS. 3 and 4, each of the sidewalls 164 and 166 of the horizontal support member 72 includes a channel 194 extending along the entire length of horizontal support member 72. The channel 194 includes a lip 196 extending upwardly past the bottom 198 of the channel 194. The lip 196 defines a U-shaped lower area of channel 194 that allows various components to be mounted to the horizontal support member 72, as will be discussed in greater detail below.

Each of the sidewalls 164 and 166 includes an access opening 198 extending inward from both the first end 168 and the second end 170, as can be seen in FIGS. 3 and 6. As can best be seen in FIG. 6, when the horizontal support member 72 is properly positioned along the pair of vertical posts 70 and mounted thereto as described above, the access opening 198 formed in each end of the horizontal support member 72 is aligned with one of the hook openings 116 formed in the vertical post 70.

Referring now to FIGS. 2 and 3, the bottom wall 162 of each horizontal support member 72 includes a U-shaped cut-out 200 extending inward from both the first end 168 and the second end 170. Each cut-out 200 terminates along a curved edge 202. As can be understood in FIGS. 2 and 29, the curved edge 202 is spaced far enough inward from either the first end 168 or the second end 170 such that when the horizontal support member 72 is connected between the pair of vertical posts 70, a gap exists between the edge surface 124 of the vertical post 70 and the curved edge 202. This gap allows wires or other components to be threaded between the spaced horizontal support members 72.

Additionally, the cut-outs 200 allow each horizontal support member 72 to be attached between the pair of vertical posts 70 without first separating the vertical posts 70. As shown in position A of FIG. 6, the full post section 74 is received in the cut-out 200 along the first end 168 to permit the horizontal support member 72 to be angled as shown. Once positioned between the vertical posts 72, the horizontal support member 72 can be properly aligned as discussed above.

Figure 13:
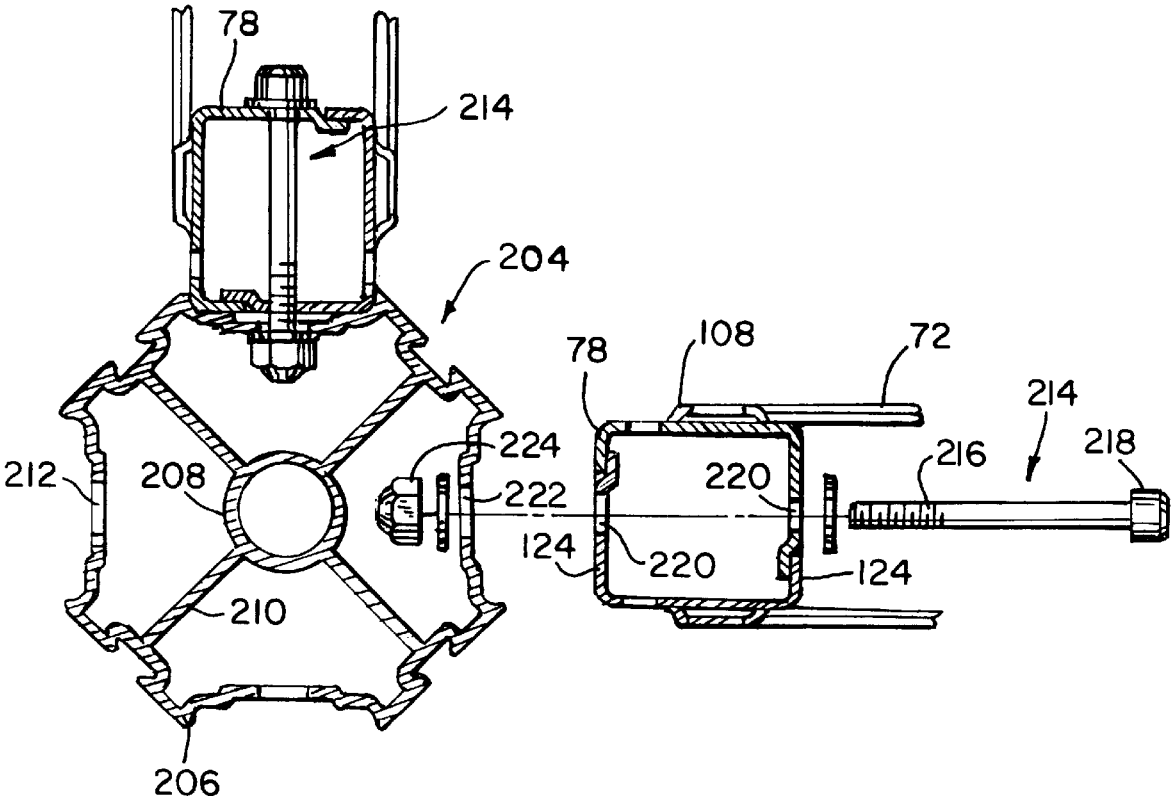
FIG. 13 is a top exploded partial section view illustrating the interconnection between a pair of vertical half post sections and a corner post for use in the system of FIG. 1.

Referring back to FIG. 2, a pair of corner posts 204 are used to create a 90° connection between adjacent panel frames 66. Specifically, the pair of corner posts 204 are used to connect the half post sections 78 contained in each of the panel frames 66 positioned at the 90° corner. Referring to FIG. 13, each corner post 204 includes an outer web 206 joined to a center portion 208 by a plurality of radial webs 210. In the preferred embodiment of the invention, the corner post 204 is formed from extruded aluminum.

The corner post 204 defines four individual receptacles 212 that are each sized to receive the edge surface 124 of the half post section 78. In the preferred embodiment of the invention, each of the half post sections 78 is joined to the corner post 204 by a connector 214 having a threaded shaft 216 and an expanded head portion 218. The threaded shaft 216 passes through aligned holes 220 contained in each of the edge surfaces 124. The threaded shaft 216 passes through an opening 222 contained in the receptacle 212 formed by the outer web 206 of the corner post 204. A nut 224 receives the threaded shaft 216, such that the nut 224 and connector 214 secure the half post section 78 to the corner post 204. As can be understood in FIG. 2, the pair of corner posts 204 are spaced vertically along the overall height of the vertical posts 70 to provide the required points of connection between the two panel frames 66.

Tiles 68 are mounted to each panel frame 66 in a manner illustrated in FIGS. 14–22. Each tile 68 is mounted between the upper and lower horizontal support members 72 to provide a solid wall construction for each of the panel frames 66, as is conventional in space dividing or partitioning systems. However, as can be seen in FIG. 15, each tile 68 includes a planar rear surface 226 that is placed in close contact with the panel frames 66. Each tile 68 is hung on the panel frame 66 by a plurality of tile retaining hooks 228. Each of the tile retaining hooks 228 is a component separate from both the tile 68 and the panel frame 66. Therefore, unlike the tiles used in previous panel systems, the rear surface 226 of the tile 68 is generally planar such that when tiles 68 are stacked and shipped, there is no danger that hooks contained on the tiles can damage adjacent tiles or can be bent or snapped off, as is the case with tiles used in prior art space dividing or partitioning systems. Further, the elimination of permanently mounted hooks allows tiles 68 to be closely stacked, in that facing surfaces of adjacent tiles are in direct contact with each other. In the case of tiles having permanently-mounted hooks, the hooks extend from a rear surface of the tile and prevent facing surfaces of adjacent tiles from contacting each other. This provision of separate retaining hooks 228 thus functions to significantly compress the space required for stacking tiles for shipment or storage.

Figure 16:
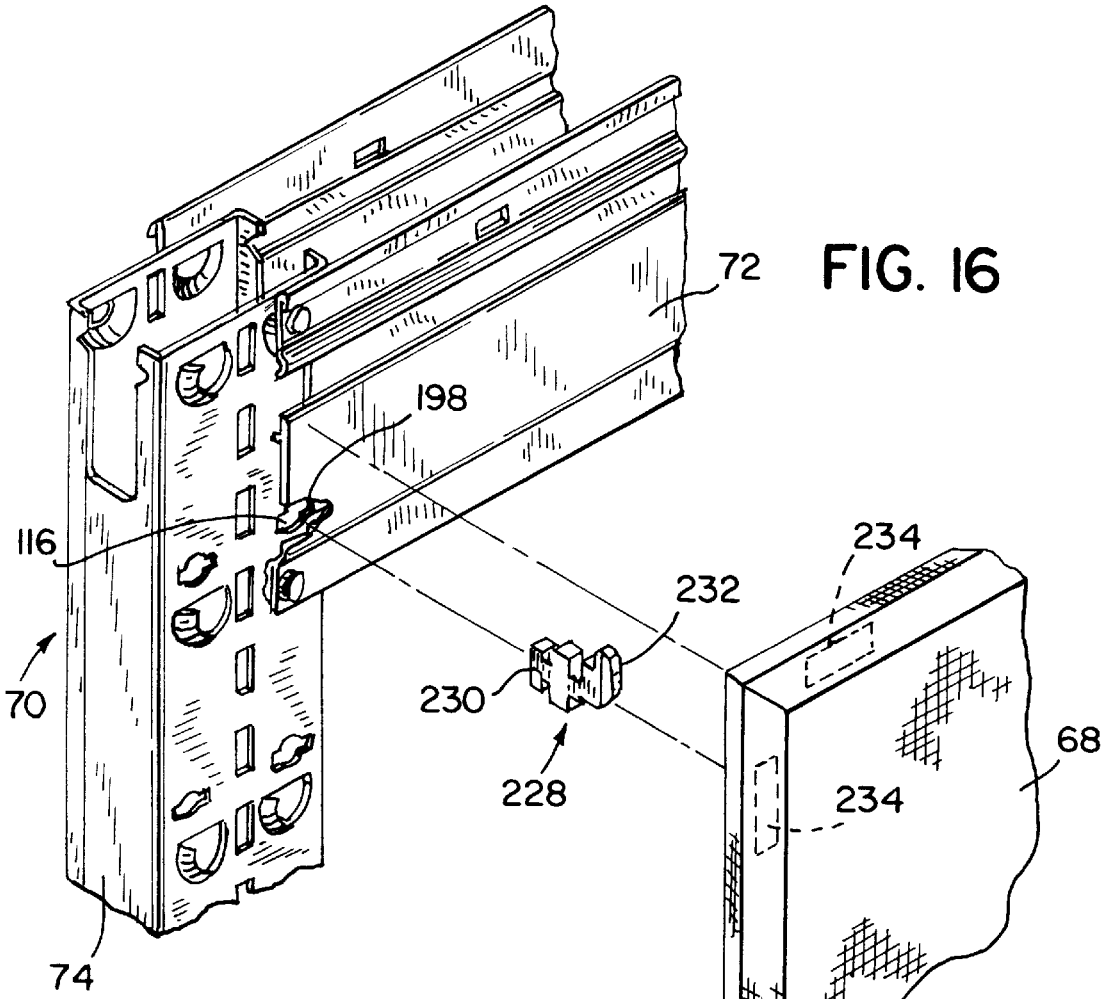
FIG. 16 is an enlarged partial isometric view showing the tile mounting arrangement of FIG. 15.

Each tile retaining hook 228 generally includes a main body portion 230 having a support hook 232 extending therefrom. The main body portion 230 is inserted into the vertical post 70 such that the tile retaining hook 228 is retained within the vertical post 70. The support hook 232 is received within a recessed hook channel 234 formed in the tile 68. As can be seen in FIG. 16, the tile 68 includes a pair of hook channels 234 positioned normally to each other. Since each tile 68 includes hook channels 234 extending horizontally and vertically, the orientation of the tile 68 can be rotated 90° while still being able to be supported by the tile retaining hooks 228 positioned on the panel frame 66.

Each tile retaining hook 228 is inserted into either the full post section 74 or the half post section 78 as follows. Initially, the tile retaining hook 228 is oriented in the direction shown in FIG. 17*a*. When positioned as shown, the main body portion 230 can be inserted through both the access opening 198 formed in the horizontal support member 72 and the hook opening 116 formed in the full post section 74. Specifically, the main body portion 230 passes through the pair of notches 120 contained on the hook opening 116.

Figure 17A:
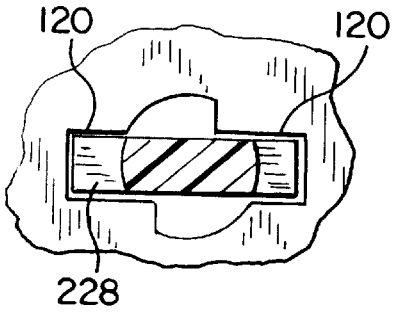
FIG. 17*a* is an enlarged partial front elevation view showing the insertion of a tile retaining hook within aligned openings in the vertical post and the horizontal support member.
Figure 17B:
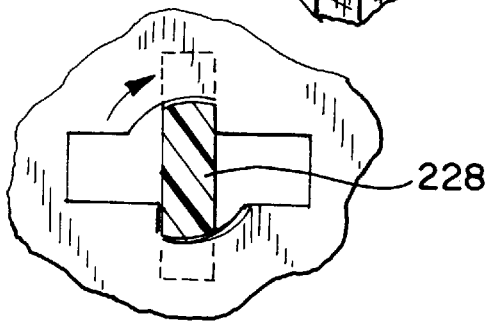
FIG. 17*b* is an enlarged partial front elevation view similar to FIG. 17*a* showing rotation of the tile retaining hook into an operative, locking position.

Once the tile retaining hook 228 is positioned within both the access opening 198 and the hook opening 116, the tile retaining hook 228 is rotated 90° to the locked position shown in FIG. 17*b*. When rotated to the position shown in FIG. 17*b*, the tile retaining hook 228 is locked in position, as shown in FIGS. 21 and 22. As can be seen in these figures, the tile retaining hook 228 includes a first, inner pair of locking tabs 236 that extend outwardly from the main body 230. The first pair of locking tabs 236 extend through access opening 198 and hook opening 116, and engage the inner surface 92 of the full post section 74. A second, outer pair of locking tabs 240 extend from the main body 230 between first locking tabs 236 and support hook 232 and are spaced from the first pair of locking tabs 236 by a distance slightly greater than the wall thickness of the full post section 74, as can be seen in FIG. 21. The second pair of locking tabs 240 has a thickness corresponding to the space between the facing surfaces of full post section 74 and horizontal support member 72. Thus, when the tile retaining hook 228 is inserted into the assembled panel frame 66, if the panel frame 66 has been improperly constructed, the tile retaining hook 228 will not rotate into the position shown in FIG. 17*b,* since the access opening 198 and the hook opening 116 will be improperly aligned. Additionally, if the panel frame 66 has been improperly constructed, the spacing between the full post section 74 and the horizontal support member 72 may be improper, such that the second pair of locking tabs 240 will not fit in the space between the full post section 74 and the horizontal support member 72.

When the tile retaining hook 228 is properly inserted as shown in FIGS. 21 and 22, tile retaining hook 228 is turned to its locked position of FIG. 17*b,* in which the edges of post section 74 adjacent hook opening 116 are received in the space between first locking tabs 236 and second locking tabs 240. In addition, second locking tabs 240 are engaged with the rear surface of the wall of horizontal support member 72, which is received within a notch 241 formed between the upper one of second locking tabs 240 and support hook 232. Thus, when tile retaining hooks 228 are in the locked position of FIG. 21, tile retaining hooks 228 function to interlock horizontal support member 72 with post 70 so as to prevent relative movement between horizontal support member 72 and post 70. Tile retaining hooks 228 thus perform the dual function of providing an interlock between post 70 and horizontal support member 72, as well as providing a hook structure for mounting tiles 68.

When tile retaining hook 228 is in its locked position of FIG. 17*b,* the support hook 232 is oriented upward and can be received within the hook channel 234 formed in tile 68. As shown in FIG. 21, the support hook 232 is substantially smaller than channel opening 242, such that when the tile 68 is installed, the tile 68 slides downward until the support hook 232 engages an upper wall 244 of the hook channel 234. The upper wall 244 includes an outer lip 246 that prevents the support hook 232 from being pulled out of the hook channel 234 after the tile 68 has been installed. The hook channel 234 is formed in a tile corner connector 248 that is used in constructing each individual tile 68 in a manner that will be discussed in greater detail below. The tile corner connector 248 is formed from a plastic material and includes the pair of hook channels 234 positioned normally to each other.

Referring to FIG. 22, the tile retaining hook 228 positioned near the bottom edge of tile 68 does not support the weight of the tile 68 when the tile 68 is hung on the panel frame 66. As can be seen in FIG. 22, the support hook 232 does not interact with any portion of the tile corner connector 248 to support the weight of the tile 68. Rather, the support hook 232 is received within the hook channel 234 and functions to prevent lateral movement of the tile 68, since the support hook 232 cannot move laterally within the hook channel 234. In addition, a lip 247 formed at the end of hook channel 234 opposite lip 246 overlaps the upper end of the lower support hook 232 to prevent outward movement of the lower end of tile 68. Since the tile retaining hook 228 located near the lower portion of the tile 68 is inserted into the panel frame 66 in the identical manner as the tile retaining hook 228 supporting the upper portion of the tile 68, the lower tile retaining hook 228 also assures that the horizontal support member 72 is correctly aligned with the full post section 74 and provides an interlock therebetween.

Each tile 68 is installed by first positioning tile 68 such that tile retaining hooks 228 are first inserted into hook channels 234 and lips 246, 247 are located above the upper and lower support hooks 232, respectively. Tile 68 is then moved vertically downwardly such that upper and lower tile retaining hooks 228 are engaged within hook channels 234 as shown in FIGS. 21 and 22, respectively, to engage tile 68 with panel frame 66. Tiles 68 are removed by reversing these steps.

As was discussed earlier, the full post section 74, as well as the half post section 78, includes a series of hook openings 116 spaced along the entire length of the post. Thus, it can be understood that a horizontal support member 72 and tile retaining hooks 228 could be aligned with any one of the hook openings 116, such that tiles 68 having different lengths and widths can be supported along the panel frame 66 by simply installing a horizontal support member 72 and moving the tile retaining hooks 228 to the desired position. In this manner, the space dividing or partitioning system 60 of the present invention can be configured to support many types of tile configurations based on user requirements.

Figure 18:
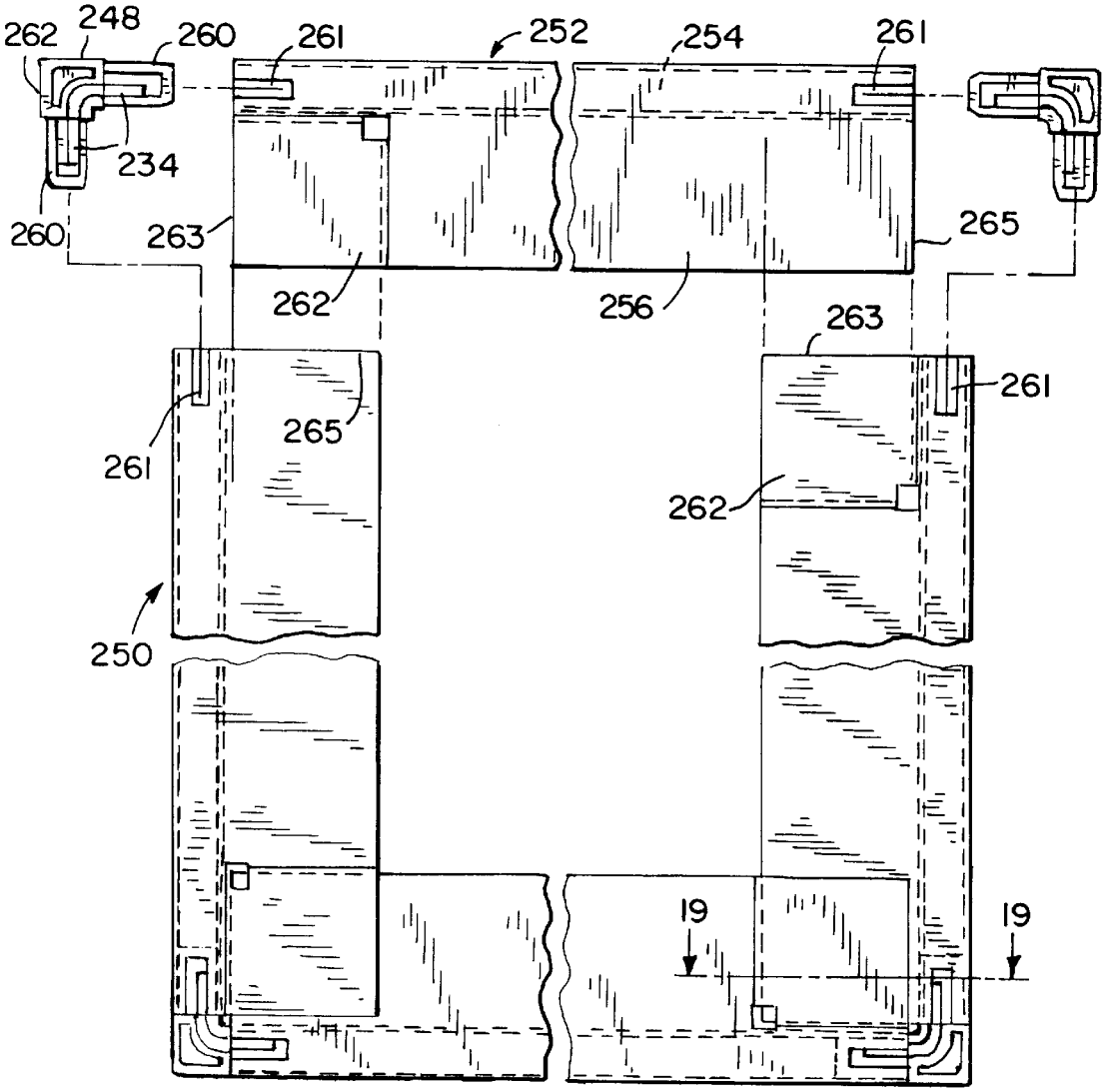
FIG. 18 is an exploded front elevation view showing the construction of the frame of a tile member for use in the system of FIG. 1.
Figure 20:
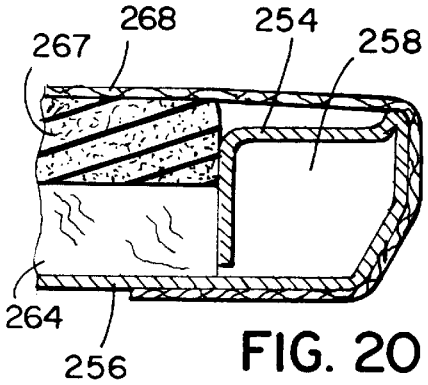
FIG. 20 is an enlarged partial section view showing construction of the tile frame of FIG. 18.
Figure 19:
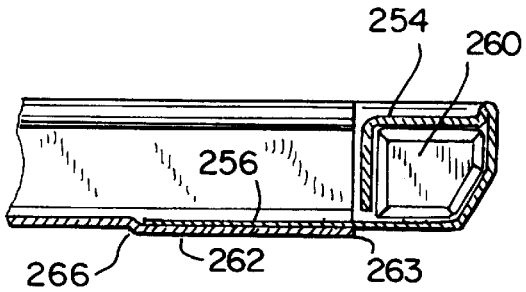
FIG. 19 is a partial section view taken along line 19—19 of FIG. 18.

Each tile 68 is constructed in a manner as shown in FIGS. 18–20. Each tile 68 generally includes a rectangular tile frame 250 constructed from four frame members 252 each joined by one of the tile corner connectors 248. Each frame member 252 generally includes a channel 254 and an inwardly extending attachment flange 256 formed from a single piece of material. Representatively, each frame member 252 may be formed from twenty gauge cold rolled steel. As can be seen in FIG. 20, the channel 254 defines a passage 258. The attachment flange 256 extends from the channel 254. The tile corner connector 248 includes a pair of stem portions 260 each extending from main body portion 262 to form a 90° angle. The stem portion 260 is received within passage 258 defined by the channel 254 and creates a friction fit therebetween, as best shown in FIG. 19.

Each attachment flange 256 includes a raised portion 262 along its first end 263 that overlaps a second end 265 of the attachment flange 256 of the adjacent frame member 252, as best shown in FIG. 19. The raised portion 262 is set off from the remaining portion of the attachment flange 256 by a bend 266. Thus, once the components of an entire tile frame 250 are assembled as shown in FIG. 18, the raised portion 262 on the first end 263 of each attachment flange 256 can be spot welded to the second end 265 of the attachment flange 256 of the adjacent frame member 252 to securely form the tile frame 250. Corner connectors 248 are thus trapped in position due to engagement of stem portions 260 within channels 254 of adjacent frame members 252. Corner connectors 248 have a cross-section generally corresponding to that of channel 254, such that the exposed area of each corner connector 248 functions to provide a completed 90° corner between adjacent ends of channels 254.

A slot 261 is formed in the rear wall of each channel 254 adjacent each end thereof. Slot 261 functions to expose hook channels 234, which are formed in each stem 260 of each corner connector 248.

After the tile frame 250 has been constructed in the manner identified above, a tile core 264 and an acoustically absorptive sponge member 267 are inserted into the assembled tile frame 250. A fabric cover member 268 is stretched across the front of the sponge member 267 and attached to the frame member 252 in a conventional manner, as shown in FIG. 20. Representatively, the fabric cover member 268 may be attached to the frame member 252 by a conventional adhesive.

Figures 23, 24:
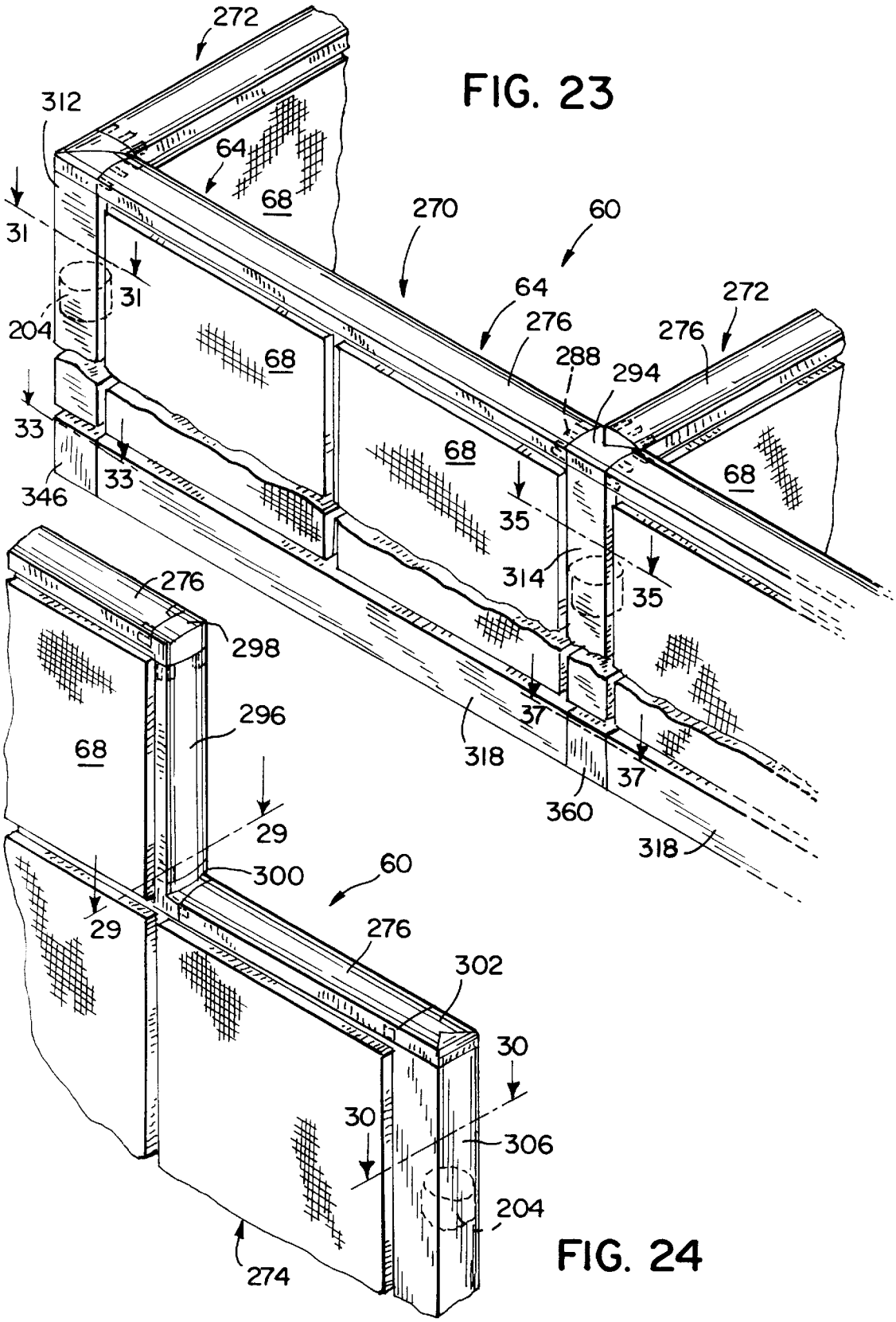
FIG. 23 is a partial isometric view illustrating the space dividing or partitioning system of FIG. 1.
FIG. 24 is an enlarged isometric view showing an alternate configuration for the space dividing or partitioning system of the present invention.

Two types of possible configurations for the space dividing or partitioning system 60 of the present invention are shown in FIGS. 23 and 24. In FIG. 23, a configuration having a continuous main wall 270 formed from a series of panels 64 each including tiles 68 is connected to at least a pair of cross walls 272, each of which are also formed from one or more interconnected panels 64, each including a tile 68.

In FIG. 24, a wall is constructed having a reduced height panel 274. Reduced height panel 274 is formed from a vertical post 70 having only one full post section 74 or half post section 78, rather than the two joined post sections as previously described. Since each vertical post 70 is formed on site by joining two individual post sections with a splice section, as was shown and described in FIG. 2, the reduced height wall section 274 can be easily constructed on site by simply using only one of the two vertical post sections.

Attached to the top of each panel 64 is a panel top cap 276, as best shown in FIGS. 23 and 28. The panel top cap 276 provides decorative trim for the upper edge of each panel 64, and also functions to enclose the upwardly facing channel defined by the topmost horizontal support member 72. As shown in FIG. 28, the panel top cap 276 includes a curved upper wall 278 that contacts and is supported by a top end 280 of the horizontal support member 72. The panel top cap 276 includes a pair of attachment tabs 282 that flex outward and extend along the entire length of the panel top cap 276. As can be seen in FIGS. 28 and 28*a*, the attachment tabs 282 engage the sidewalls 164, 166 of the horizontal support member 72 between the top end 280 and a bulge 284 formed in each sidewall 164 and 166. When the panel top cap 276 is attached as shown in FIGS. 28 and 28*a*, the attachment tabs 282 flex outward and exert a bias force against the sidewalls 164 and 166 to hold the panel top cap 276 in place along the horizontal support member 72.

Referring back to FIG. 23, a three-way intersection post cover 294 is positioned over a three-way interconnection of panels 64. The three-way post cover 294 also includes a plurality of tongues 288 that interact with the adjacent panel top caps 276 to secure the panel top caps 276 in position as shown.

Figure 29:
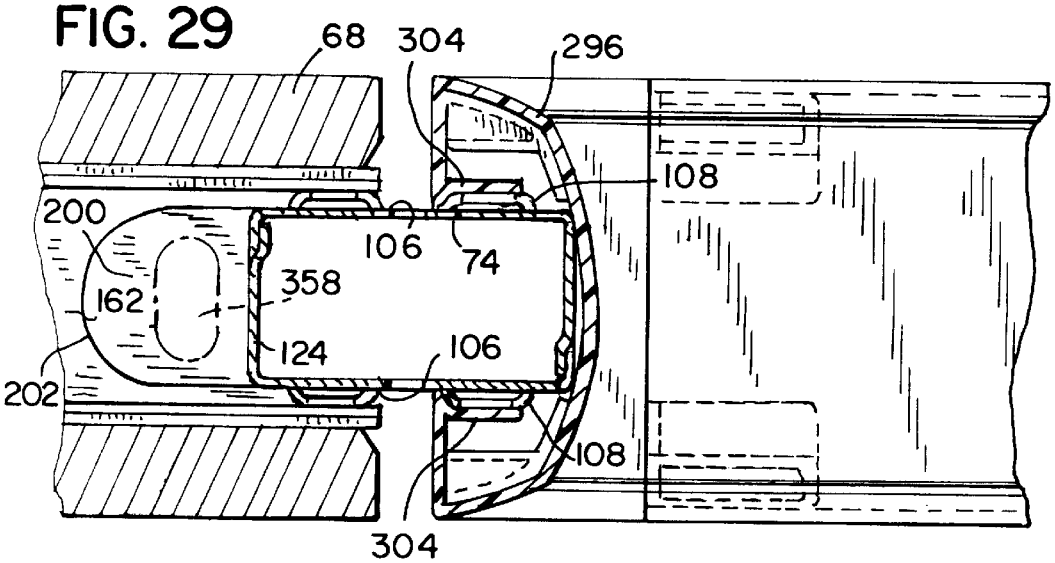
FIG. 29 is a partial section view taken along line 29—29 of FIG. 24.

Referring now to FIGS. 24 and 29, an end-of-run trim section 296 extends vertically between the upper panel top cap 276 and the lower panel top cap 276. The end-of-run trim section 296 is joined extends between an outer corner trim section 298 and an inner corner trim section 300. The lower panel top cap 276 terminates at a post cover 302.

Referring now to FIG. 29, the end-of-run trim section 296 extends vertically and includes a pair of tabs 304 that extend along the length of the end-of-run trim section 296 and engage the face surfaces 106 of the full post section 74. When the end-of-run trim section 296 is installed, tabs 304 flex outward and engage receptacles 108, to retain the end-of-run trim section 296 in place along the full post section 74.

Figure 30:
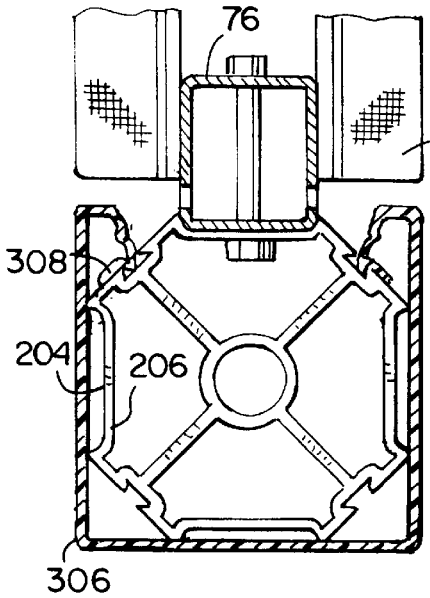
FIG. 30 is a partial section view taken along line 30—30 of FIG. 24.
Figure 32:
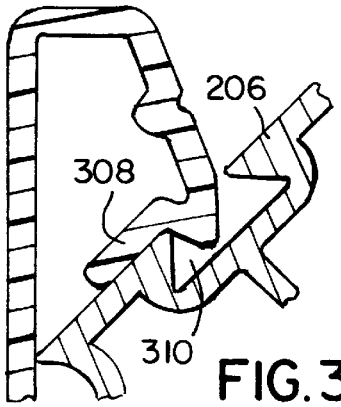
FIG. 32 is an enlarged partial section view showing the interaction between the corner post and the corner trim.
Figure 36:
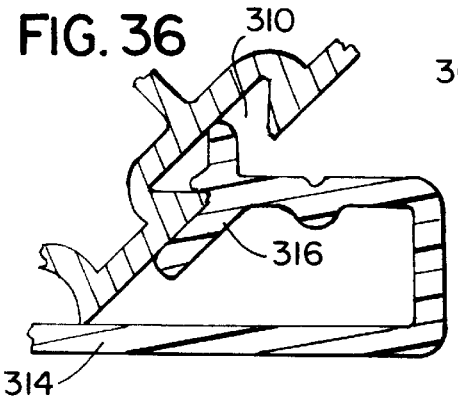
FIG. 36 is an enlarged section view showing the interaction between the corner post and the trim cover of FIG. 35.

In addition to the sections of trim placed over the top edge of each panel 64, a series of vertical trim sections are used to cover each vertical corner post 204 at each corner in the space dividing or partitioning system 60 of the present invention. As shown in FIGS. 24 and 30, a three-sided corner post cover 306 is attached to the pair of corner posts 204 at the end of a single wall. The corner post cover 306 extends from the post cover 302 to the ground to provide a finished appearance for the corner of the reduced height panel 274. Corner post cover 306 includes a pair of tabs 308 that snap into a pair of cavities 310 formed in the outer web 206 of the corner post 204 as shown in FIG. 32.

Figure 31:
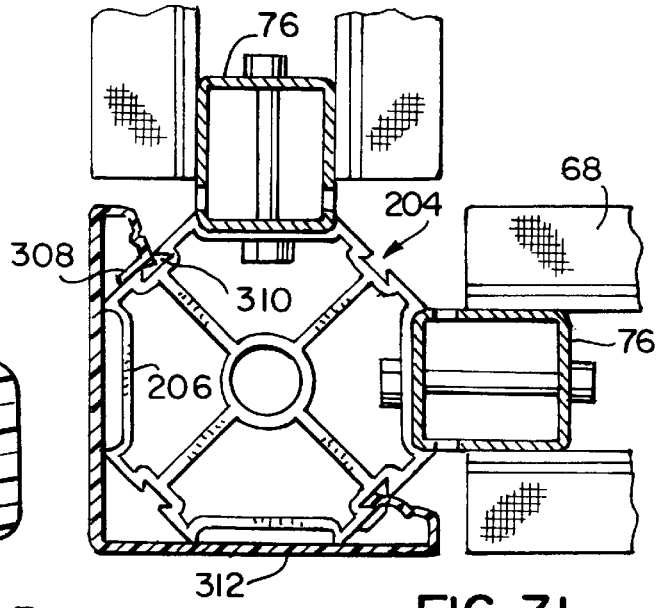
FIG. 31 is a partial section view taken along line 31—31 of FIG. 23.

Like the three-sided post cover 306, a two-sided post cover 312 is used to create a finished appearance between a pair of orthogonally joined panels 64, as shown in FIGS. 23 and 31. As can best be seen in FIG. 31, the two-sided corner post cover 312 also includes a pair of tabs 308 that engage the cavities 310 formed in the outer web 206 of the corner post 204.

Figure 35:
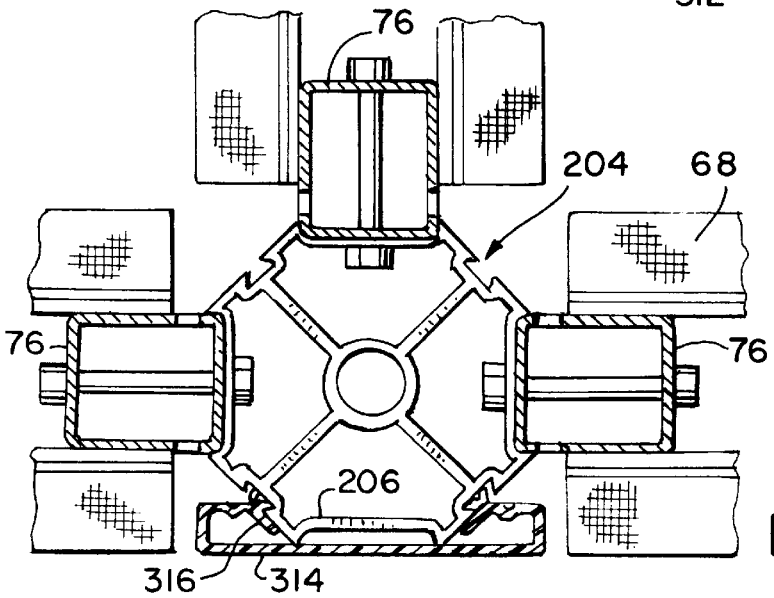
FIG. 35 is a partial section view taken along line 35—35 of FIG. 23.

Finally, a one-sided corner post cover 314 is used to provide a finished look at the intersection of three joined panels 64, as shown in FIGS. 23 and 35. The one-sided post cover 314 includes a pair of tabs 316 that engage two of the cavities 310 formed in the outer web 206 of the corner post 204. The tabs 316 are biased to snap into the cavity 310 to hold the one-sided trim cover 314 in place along the pair of corner posts 204.

Figure 25:
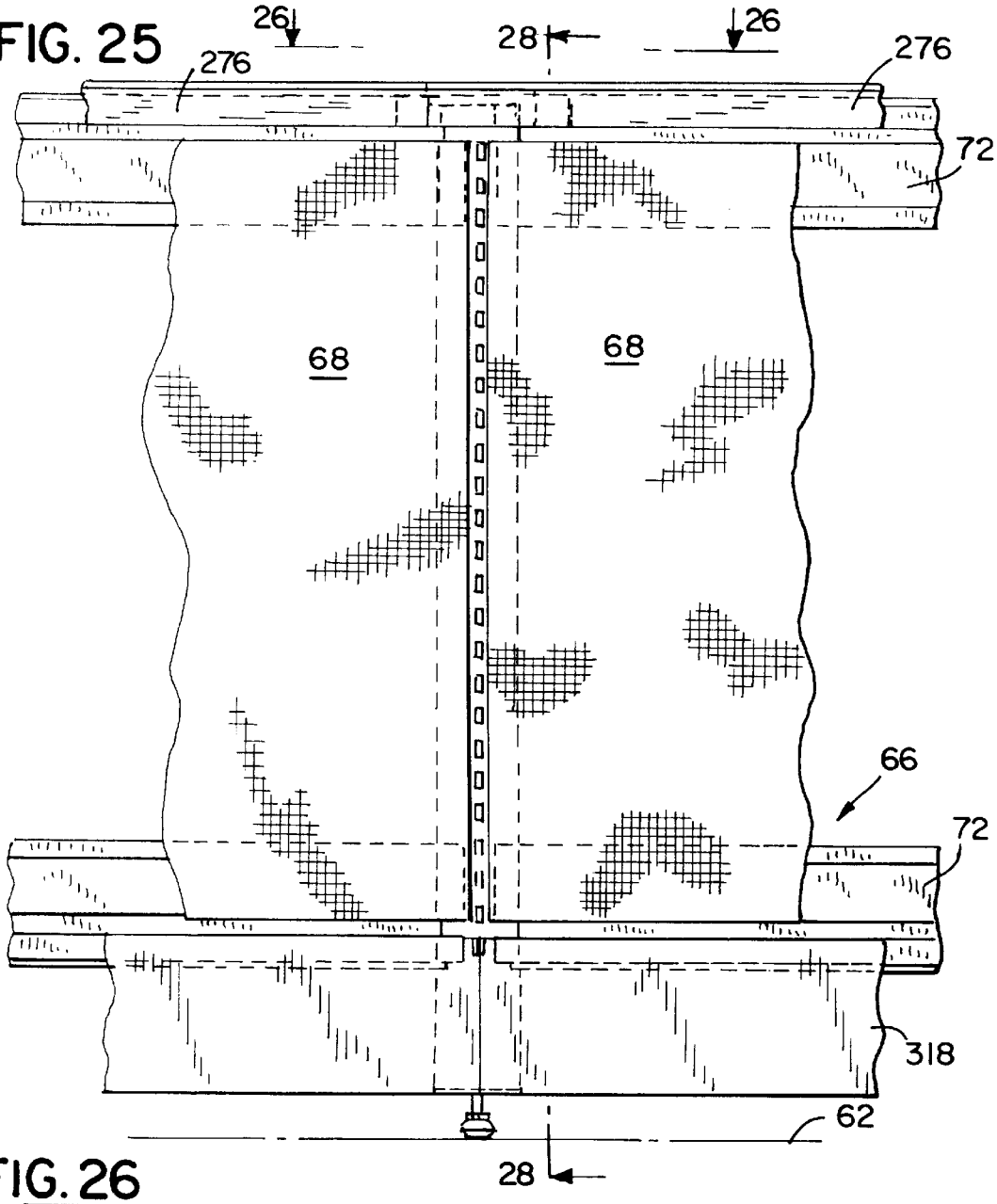
FIG. 25 is a partial front plan view illustrating a pair of panels and various trim components for the space dividing or partitioning system.
Figure 26:
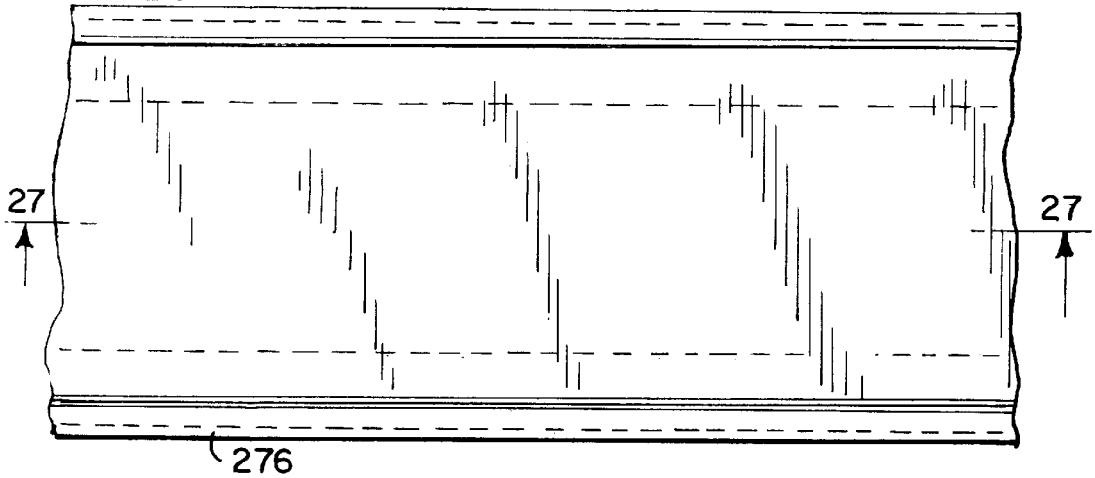
FIG. 26 is a partial top plan view taken with reference to line 26—26 of FIG. 25.

FIGS. 25 and 28 illustrate a base cover 318 that is attached to the lowermost inverted horizontal support member 72 of the panel frame 66. The base cover 318 is positioned below the tile 68 and is spaced slightly above the floor 62. As will be discussed in greater detail below, the base cover 318 not only provides decorative trim below the horizontal support member 72, but also functions to enclose an electrical and communication wireway.

As can be seen in FIG. 28, the base cover 318 is formed from a pair of base sides 320 and a base bottom 322. The base sides 320 and the base bottom 322 are separately formed from extruded PVC and are subsequently joined to form the structure shown. Specifically, each of the base sides 320 includes a tongue 324 that is received in a corresponding groove 326 formed in the base bottom 322, as shown in FIG. 28*c*. The tongue 324 includes an expanded end 328 that prevents the base side 320 from becoming laterally detached from the base bottom 322. During assembly of the base cover 318, the tongue 324, including the expanded end 328, is slid longitudinally into the groove 326 in the base bottom 322 and subsequently joined to the base bottom 322 by a hot melt or adhesive process.

The base cover 318 is supported between adjacent vertical posts 70 by the interaction between the base bottom 322 and the glide housing 130 or 134 contained on each vertical post 70. Specifically, the base bottom 322 includes a pair of upwardly extending tabs 330 that engage the second shoulder 154 of the glide housing 134 as shown in FIG. 28*c*. Additionally, the base bottom 322 includes alignment tabs 332 that are received in the notches 160 of the glide housing 134.

Referring back to FIG. 28, the area of each base side 320 adjacent the outer edge of base bottom 322 defines a living hinge which allows the base sides 320 to flex outward, as shown in phantom. Thus, when the base sides 320 flex outward, the open area below the lower inverted horizontal support member 72 is accessible, as will be discussed in detail below. Each of the base sides 320 includes a sidewall 334 that extends upward and terminates at a top wall 336 as shown in FIG. 28*b*. Top wall 336 is joined to an inner wall 338 that includes a latch portion 340. The latch portion 340 includes a tab 342 extending from a receipt cavity 344. When the base side 320 is pushed inward, the tab 340 contacts the end 280 of the inverted lower horizontal support member 72, such that the end 280 is received and retained within the receipt cavity 344. As was previously discussed, the lower horizontal support member 72 is inverted such that the opening to the horizontal support member 72 faces downward.

To open either of the base sides 320, the top wall 336 can be grasped and pulled outward to cause the latch portion 340 to flex downward, thereby permitting the tab 342 to pass below the top end 280 of the horizontal support member 72.

Figure 34:
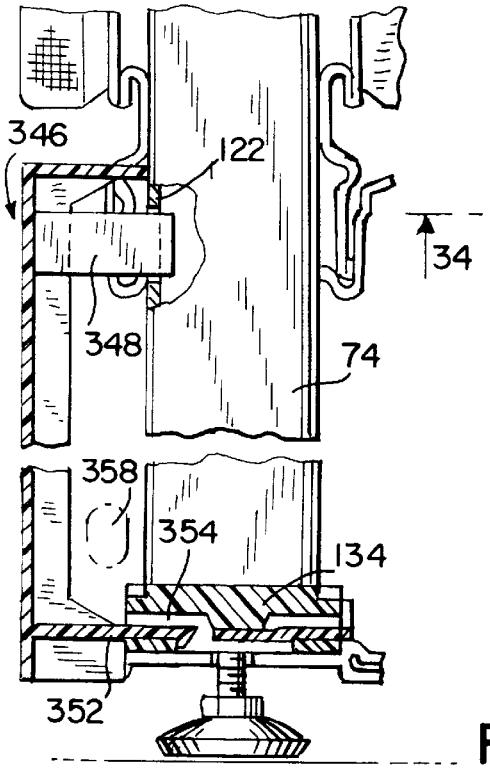
FIG. 34 is a partial section view taken along line 34—34 of FIG. 33.
Figure 33:
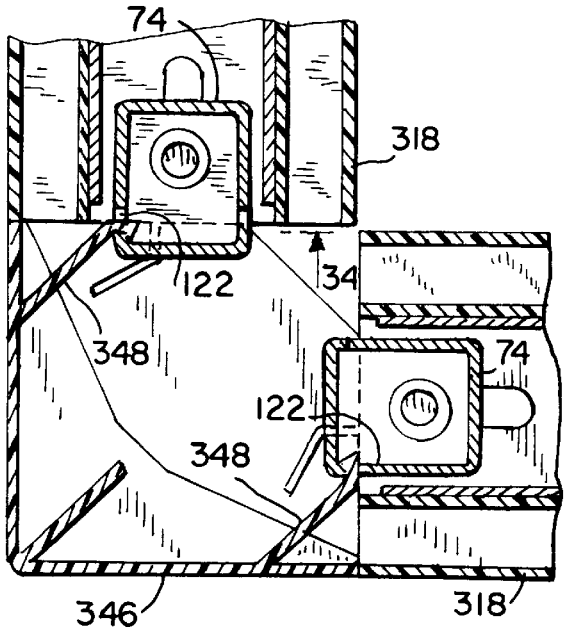
FIG. 33 is a partial section view taken along line 33—33 of FIG. 23.

Referring now to FIGS. 23 and 33, a base corner cover 346 is positioned between the pair of base covers 318 at the corner between adjacent panels 64. As shown in FIGS. 33 and 34, the base corner cover 346 includes a pair of upper attachment tabs 348 that pass through the support slots 122 contained in each of the half post sections 74. A second pair of attachment tabs 352 is received in a passageway 354 in the glide housing 134 as shown in FIG. 34, and a snap-type retainer arrangement is provided between the end of each attachment tab 352 and a wall of passageway 354. Outer wall 356 of the base corner cover 346 is spaced from the half post section 74 by a distance sufficient to permit passage of one or more wires 358 therebetween.

Figure 38:
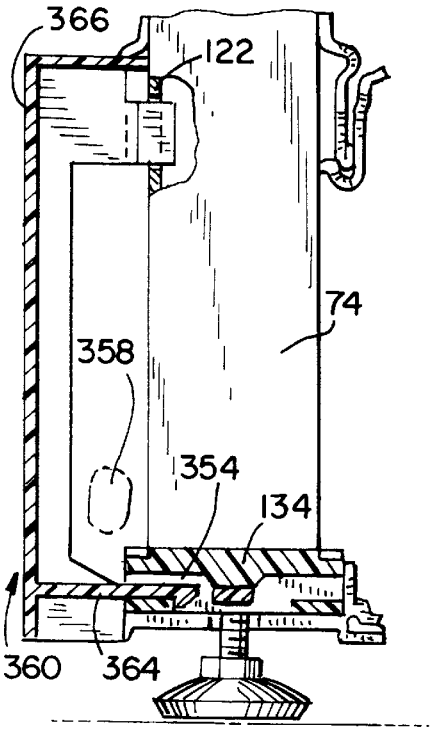
FIG. 38 is a partial section view taken along line 38—38 of FIG. 37.
Figure 37:
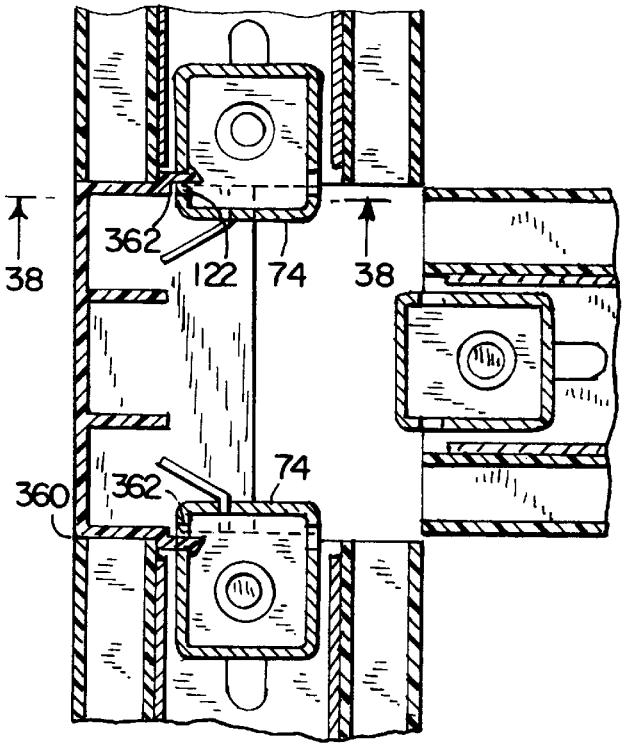
FIG. 37 is a partial section view taken along line 37—37 of FIG. 23.
Figure 39:
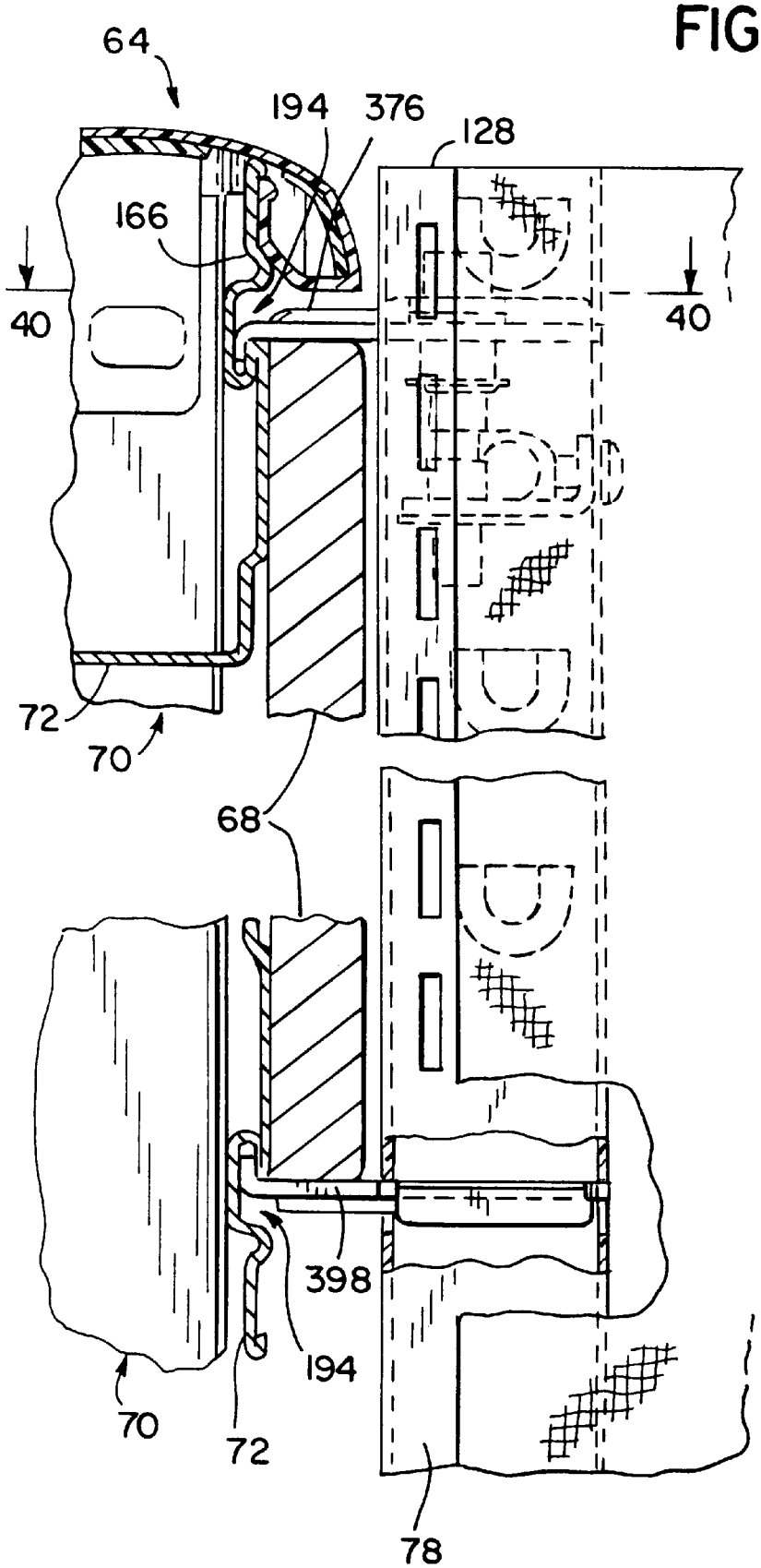
FIG. 39 is a partial side elevation view illustrating the stabilizing connection between a vertical half post section and a stationary wall member.
Figure 40:
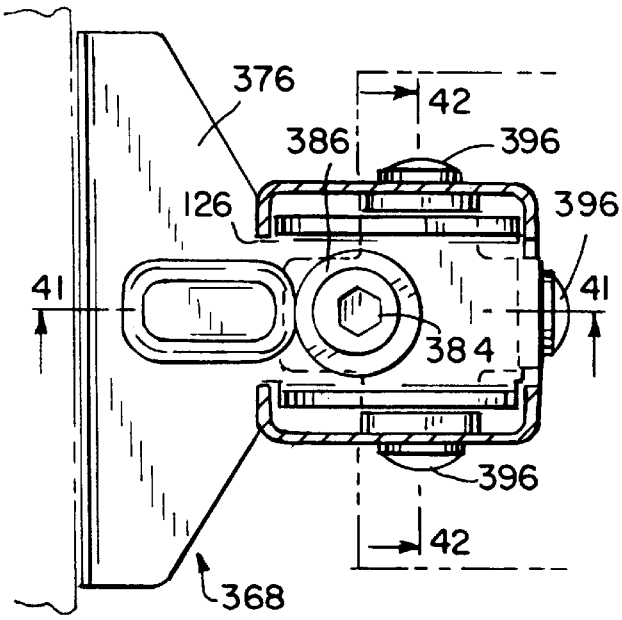
FIG. 40 is a partial section view taken along line 40—40 of FIG. 39 illustrating a clamp mechanism used to stabilize the half post section.
Figure 41:
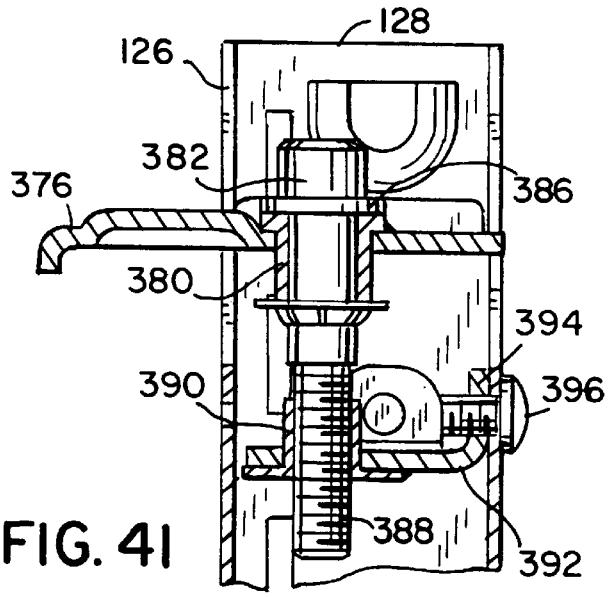
FIG. 41 is a partial section view taken along line 41—41 of FIG. 40.
Figure 42:
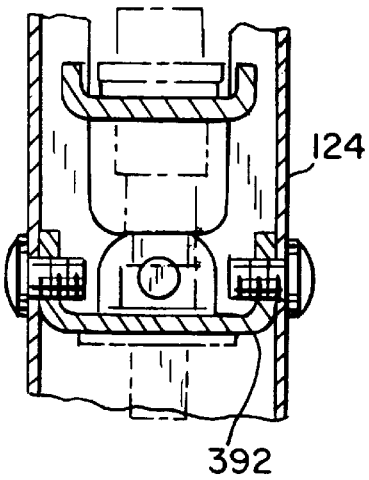
FIG. 42 is a partial section view taken along line 42—42 of FIG. 40.

In addition to the base corner cover 346, a base trim cover 360 is positioned between adjacent sections of the base cover 318, as shown in FIGS. 23 and 38. The base trim cover 360 includes a pair of upper attachment tabs 362 that each engage support slots 122 in one of the half post sections 74. A lower pair of attachment tabs 364 are received in the passageways 354 formed in the glide housing 134, and a snap-type retainer arrangement is provided between the end of each attachment tab 352 and the wall of each passageway 354, to further retain the base trim cover 360. As seen in FIG. 38, outer wall 366 of the base trim cover 360 is spaced from the half post section 74 by a distance sufficient to allow passage of the one or more wires 358.

FIGS. 39–42 illustrate a clamp mechanism 368 used to secure one of the half post sections 78 to another wall panel 64. The clamp mechanism 368 includes a clamp member 376 positioned to extend through the access notch 126 formed near the top end 128 of the half post section 78. The clamp member 376 extends generally horizontally and terminates with a depending lip 378. The lip 378 engages the recess lip 196 of a horizontal support member 72 forming a part of wall panel 64. A sleeve 380 extends through the clamp member 376 and receives a portion of a shoulder bolt 382. Shoulder bolt 382 includes an internal hex 384. A spring washer 386 is positioned between the head of the shoulder bolt 382 and the sleeve 380.

The shoulder bolt 382 includes a threaded shaft 388 that is threadedly received in a T-nut 390, which is secured to a clamp guide weldment 392. The clamp guide weldment 392 includes a pair of upwardly extending tabs 394 that each receive a threaded connector 396. Threaded connectors 396 pass through openings in the edge surface 124 of the half post section 78 to secure the clamp guide weldment 392 in position. Thus, as can be understood in the figures, as the shoulder bolt 382 is rotated, the threaded interaction between the threaded shaft 382 and T-nut 390 causes clamp member 376 to move downward into contact with the lip 196. By further tightening of the shoulder bolt 382, the clamp member 376 is securely moved into engagement with lip 196 to securely fix the upper end of half post section 78 to wall panel 64.

A fixed lower clamp member 398 having a lip 399 is mounted within the half post section 78 and engages lip 196 of a lower horizontal support member forming a part of wall panel 64. The lower clamp member 398 is not vertically adjustable, but is positioned to engage the lower lip 196 to fix the lower end of the half post section 78 to wall panel 64 when bolt 382 is tightened down.

With this arrangement, half post section 78 is used in combination with the upper clamp mechanism 368 and lower clamp member 398 to position a panel at any position between a pair of vertical posts 70, including at "off module" locations.

Figure 43:
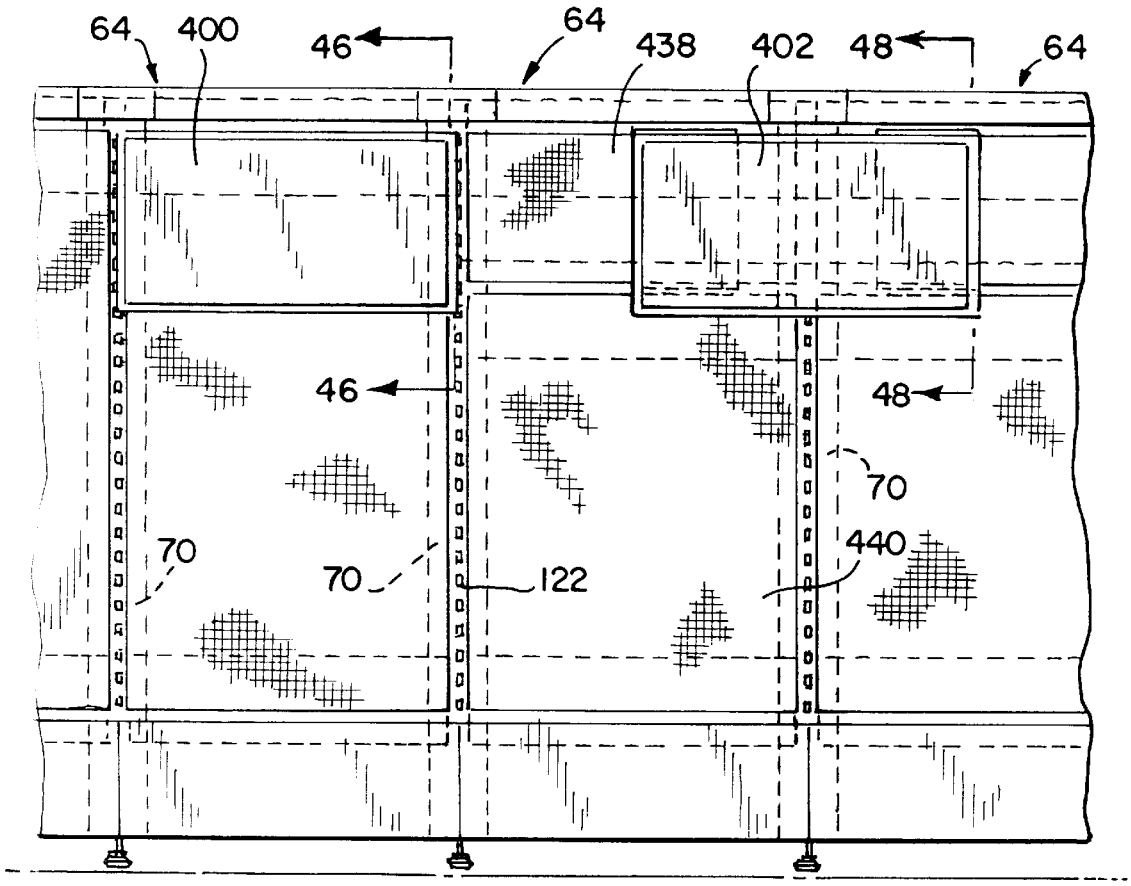
FIG. 43 is a partial front elevation view illustrating a pair of overhead storage members mounted to the space dividing or partitioning system of the present invention.

FIG. 43 illustrates two types of overhead storage members, referred to by reference numerals 400 and 402, that can be used in combination with the space dividing or partitioning system 60 of the present invention. Overhead storage member 400 is shown mounted between a pair of vertical posts 70. This type of mounting arrangement is commonly referred to as "on-module" mounting, since the overhead storage member 400 is mounted directly between the pair of vertical posts 70. The overhead storage member 402 is shown as mounted "off-module", since the overhead storage member 402 is not directly connected to a pair of vertical posts 70. The "off-module" mounting arrangement of overhead storage member 402 allows the overhead storage member 402 to be positioned in any location based on user requirements.

Figure 46:
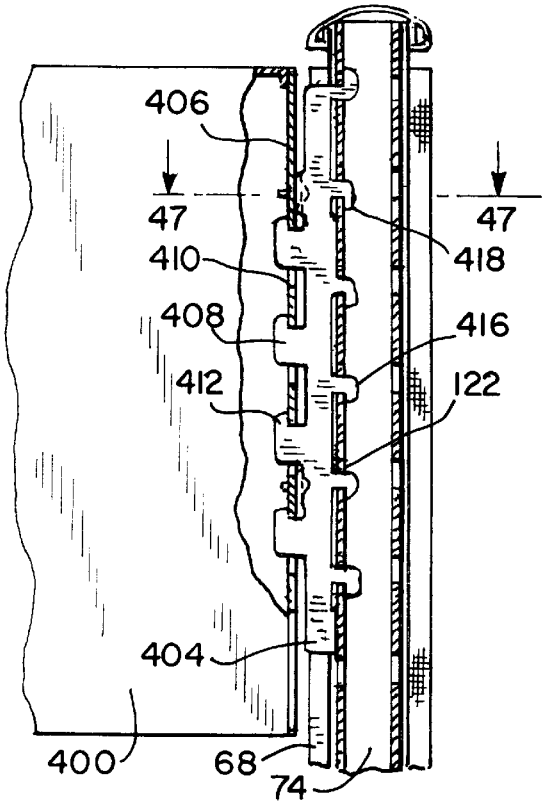
FIG. 46 is a partial section view taken along line 46—46 of FIG. 43.
Figure 47:
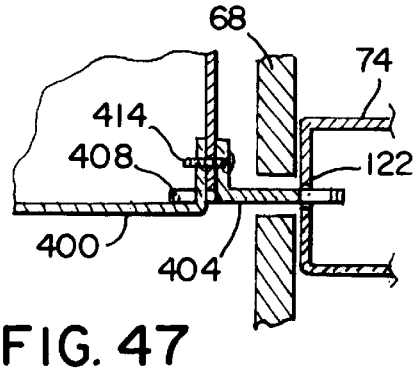
FIG. 47 is an enlarged section view taken along line 47—47 of FIG. 46.

FIG. 44 shows the mounting arrangement for the overhead storage member 400. The overhead storage member 400 includes a pair of hanging brackets 404 that are connected to a back wall 406 of the overhead storage member 400. As can best be seen in FIG. 46, each of the hanging brackets 404 includes a plurality of upwardly extending tabs 408 that extend into openings 410 formed in the back wall 406. Each of the tabs 408 includes an upper end 412 that maintains the hanging bracket 404 in engagement with the back wall 406. A plurality of connectors 414 are used to secure the hanging brackets 404 to the back wall 406 once the hanging brackets 404 have been inserted into the back wall 406 as shown.

The hanging brackets 404 include a second set of depending tabs 416 extending opposite to the first set of tabs 408. The second set of tabs 416 are each received in one of the support slots 122 formed in the full post section 74 or half post section 78. In the embodiment shown in FIG. 46, the tabs 416 of overhead storage member 400 are received within the support slots 122 of the full post section 74. Each of the tabs 416 includes a lower end 418 that contacts the inner surface 92 of the full post section 74 to secure the overhead storage member 400 as shown. As can be understood in FIG. 46, the hanging brackets 404 provide the required spacing between the overhead storage member 400 and tile 68.

FIG. 45 illustrates the mounting arrangement for the overhead storage member 402. The mounting arrangement for the overhead storage member 402 includes a pair of hook brackets 418 secured to a back wall 420 of overhead storage member 402. Each of the hook brackets 418 includes a generally vertical support plate 422 having a plurality of tabs 424 extending forwardly therefrom. The tabs 424 pass through openings 426 contained in back wall 420. As was the case with the hanging brackets 404 described in FIG. 46, the tabs 424 each include an upper end 428 that maintains the tabs 424 in engagement with the back wall 420. A plurality of connectors 430 secure each of the hook brackets 418 to the back wall 420.

As FIGS. 45 and 48 illustrate, each hook bracket 418 includes an upper support flange 432 and a lower support flange 434 extending from the support plate 422. Both the upper support flange 432 and the lower support flange 434 include a depending lip 436. As can be seen in FIG. 48, both the upper support flange 432 and the lower support flange 434 extend from the support plate 422 a distance greater than the thickness of tile 68. As FIG. 48 illustrates, the lip 436 of the upper support flange 432 is received in the channel 194 of horizontal support member 72. As previously discussed, the channel 194 extends along the entire longitudinal length of the horizontal support member 72. The extended lip 196 of channel 194 prevents the lip 436 of the upper support flange 432 from leaving the channel 194.

An intermediate horizontal support member 72 is positioned below the top horizontal support member 72 as shown in FIG. 48. The lip 436 of the lower support flange 434 is received in channel 194 of intermediate horizontal support member 72 in a manner similar to that described above. In this manner, the upper support flange 432 and the lower support flange 434 provide support for the overhead storage member 402.

As can be seen in FIGS. 43 and 48, an upper tile 438 having a width less than the width of the overhead storage member 402 is attached to top portion of the panel frame. A lower tile 440 extends down to the bottom edge of the panel frame. The separation between the upper tile 438 and the lower tile 440 allows the lower support flange 434 to pass therebetween.

Since each of the horizontal support members 72 includes a channel 194, the overhead storage member 402 can slide between the aligned horizontal support members 72 contained on adjacent panels 64, since the overhead storage member 402 is supported only by the interaction between the hook brackets 418 and the channels 194. In this manner, the overhead storage member 402 can be moved between the separate panels 64 as shown in FIG. 43 and does not have to be mounted "on-module", as is the case with overhead storage member 400.

As can be seen in FIG. 49, a threaded locking member 440 passes through the rear wall 420 of overhead storage member 402 and through support plate 422 for engagement within channel 194. The locking member 440 is used to secure the overhead storage member 402 once the overhead storage member 402 is in the desired position. Specifically, the locking member 440 is tightened in a threaded boss 441, which may be a nut welded to support plate 422, until an end portion 442 contacts the channel 194. This functions to draw overhead storage member 402 outwardly, resulting in engagement of lip 436 with channel lip 196, to frictionally lock lips 196, 436 together to prevent upward movement of the overhead storage member 402 relative to the channel 194. Locking member 440 and boss 441 extend through an opening 444 in the back wall 420 such that the locking member 440 can be tightened from the open interior of the overhead storage member 402.

The drawings illustrate mounting of overhead storage member 402 in channels 194. It should be understood, however, that any component or accessory may be mounted in channels 194 at any height. Examples include shelving, cabinets, paper management devices, computer or computer monitor supports, etc. To mount any such component or accessory, the system 60 need only be configured to provide a horizontal support member 72 at each desired elevation, and tile 68 must be configured to expose channels 194 to enable such components to be mounted.

Figure 50A:
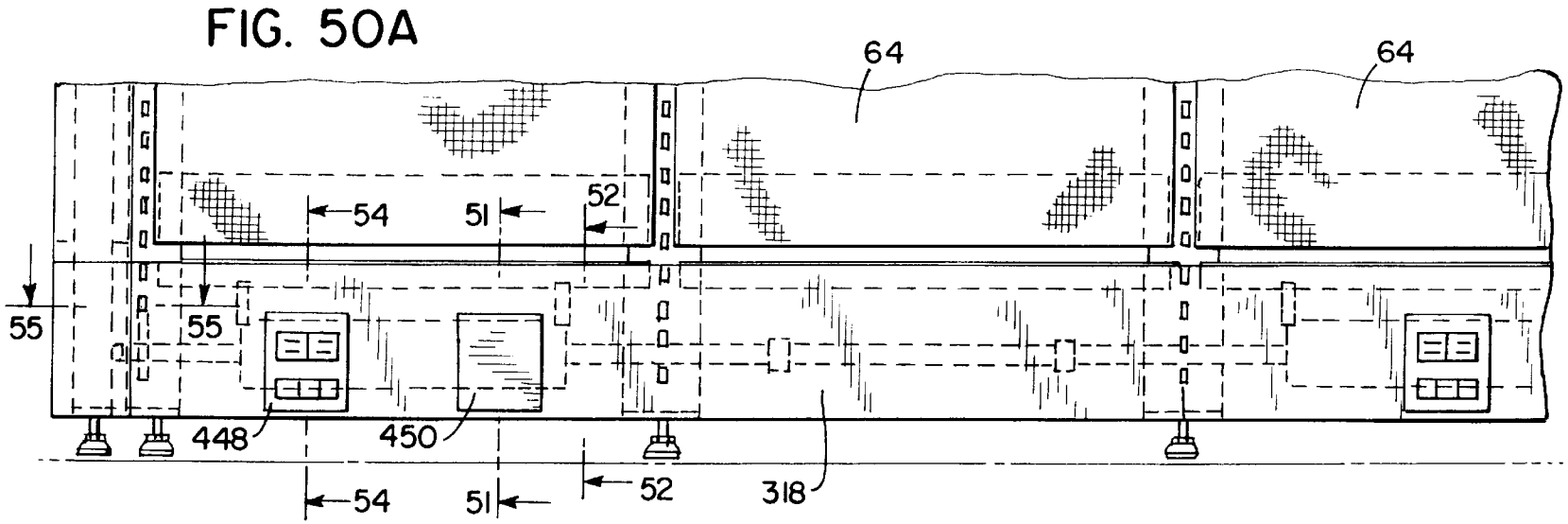
FIG. 50*a* is a partial front elevation view illustrating the lower portion of the space dividing or partitioning system of the present invention.
Figure 50B:
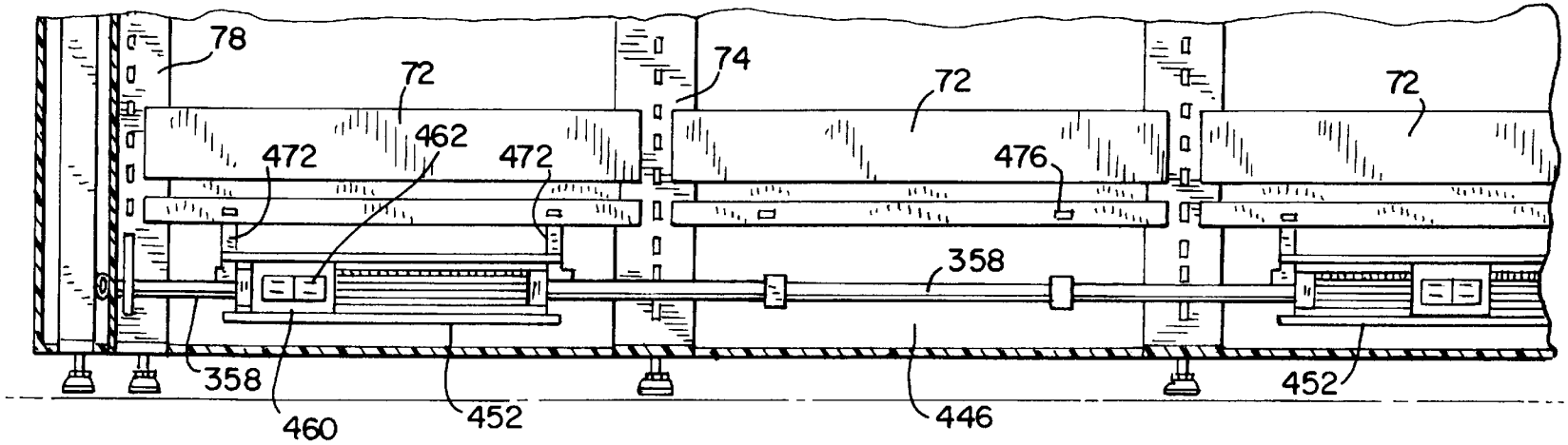
FIG. 50*b* is a front elevation view similar to FIG. 50*a* further illustrating the electric wire raceway.

The base covers 318 attached near the bottom end of each panel 64 define a raceway 446 through which electrical and communication lines may pass, as can be seen in FIGS. 50*a* and 50*b*. Each of the base covers 318 includes a pair of receptacle openings 448 and corresponding receptacle covers 450 that may be removed to provide access to the raceway 446. If the receptacle opening 448 is not needed, the receptacle cover 450 can remain within the receptacle opening 448, as best shown in FIGS. 50*a* and 51. The receptacle cover 450 is designed to match the overall appearance of the base side 320 such that the receptacle cover 450 provides an aesthetically pleasing appearance.

As can be seen in FIG. 51, the base cover 318 is constructed such that either or both of the sidewalls 320 may include the receptacle openings 448 and receptacle covers 450, or the base cover 318 may be formed without any receptacle openings. When the space dividing or partitioning system 60 of the invention is constructed, the base cover 318 is positioned such that the receptacle openings 448 face the desired direction to provide access to the raceway 446.

As was previously discussed, the lowermost horizontal channel 72 of each panel frame 66 is inverted such that the U-shaped cross-section of the horizontal support member 72 faces downward. In the preferred embodiment of the invention, each horizontal support member 72 is connected to the two lowermost receptacles 108 of either the full post section 74 or the half post section 78, as shown in FIGS. 50*b* and 14. Although in the preferred embodiment the lowermost horizontal channel member 72 is attached to the two lowest receptacles 108, each of the full post sections 74 and half post sections 78 are constructed such that the inverted horizontal support members 72 could be moved upward and connected to the second and third lowest receptacles 108 while leaving the lowest receptacle 108 open. If the inverted horizontal support member 72 is moved upward as described, the size of the raceway 446 could be expanded by using a base cover 318 having longer base sides 320.

As shown in FIG. 50*b*, the electric power connection for the space dividing or partitioning system 60 includes a series of rigid wireways 452 joined by a series of jumpers, such as shown at wire 358. As shown in FIG. 51, the rigid wireway 452 includes an electrified power strip 454 supported between a pair of rails 456. A cover member 458 is supported between the rails 456 on each side of the electrified power strip 454.

A receptacle module 460 can be positioned in contact with the electrified power strip 454 as shown in FIGS. 50*b* and 54. Receptacle module 460 includes a conventional electrical receptacle 462 that can receive conventional electrical plugs. The receptacle 462 extends past the base side 320 through a specially designed cover member 464 that fits in the receptacle opening 448 formed in the base cover 318. In addition to supporting the receptacle module 460 and the receptacle 462, cover member 464 defines an opening 466 that receives and secures a communication outlet 468. The communication outlet 468 is connected to a voice or data cable 470 that provides connections to telephones, modem lines or other types of communication devices, such as computer terminals. The data cable 470 runs within the raceway 446 along with the electric power supply.

A pair of electrical hanging brackets 472 support each of the rigid wireways 452 within the raceway 446. As shown in FIGS. 52 and 53, each electrical hanging bracket 472 includes a pair of attachment hooks 474 that engage openings 476 formed near the end 280 of each sidewall 164 and 166 of the horizontal support member 72. Specifically, each attachment hook 474 includes a projecting emboss 478 that snaps into and is retained within the opening 476. Channel 480 receives the end 280 of the horizontal support member 72, as shown in FIG. 52. In this manner, electrical hanging bracket 472 is releasably engaged with horizontal support member 72 using a vertical push-on motion, which results in deflection of the fingers of hooks 474 until embosses 478 snap into and through openings 476. Electrical hanging brackets 472 can be removed by pushing the hook fingers inwardly to disengage embosses 478 from openings 476.

The electrical hanging brackets 472 include a pair of depending arms 482 that receive and engage a molded end cap 484 attached to each end of the rigid wireway 452. Each of the arms 482 includes an alignment finger 486 and an extending emboss 488. When the electrical hanging bracket 472 is pushed downward into engagement with the molded end cap 484, the alignment fingers 486 are positioned on opposite sides of a center rail 490 of the end cap 484. The embosses 488 each engage a projection 492 on the end cap 484 to prevent the downward movement of the rigid wireway 452 with respect to the electrical hanging bracket 472. In this manner, a pair of electrical hanging brackets 472 can support the rigid wireway 452 within the wireway 446 beneath the inverted horizontal support member 72.

Figure 55:
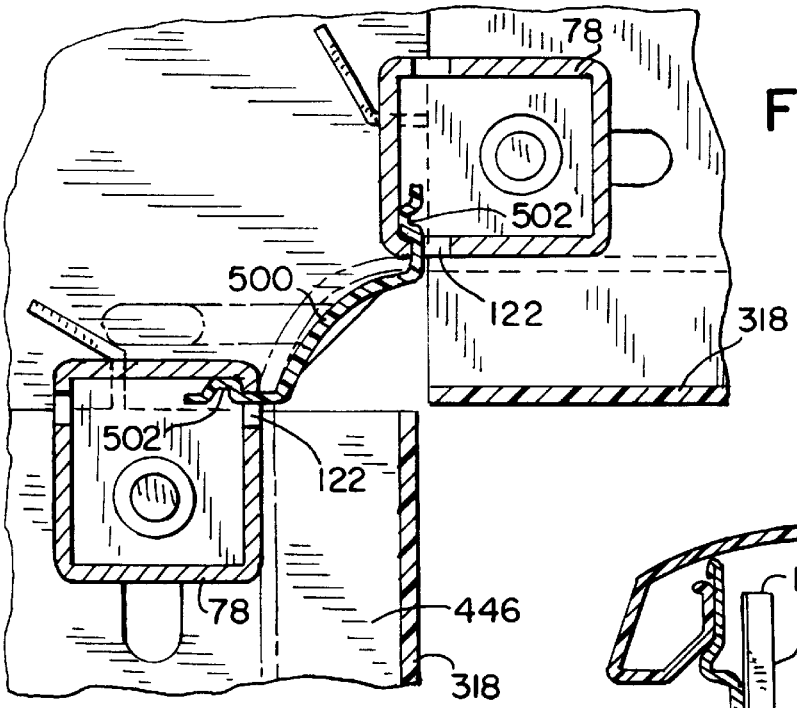
FIG. 55 is a partial section view taken along line 55—55 of FIG. 50*a;*

Wires such as 499, which may be voice or data communication wires or cables, may pass behind tiles 68 at elevations typically above the area enclosed by the base cover 318, as shown in FIG. 55. Upon reaching a 90° corner, the wire 358 passes around the corner between the adjacent panel sections 64. As shown in FIG. 55, a curved wire guide member 500 is positioned between the two half post sections 78 to guide the wire 499 around the corner. Specifically, a pair of tabs 502 formed on the wire guide 500 are received within one of the slots 122 formed in the half post section 78. The wire guide 500 shields the wire 499 traveling along the inside of the corner, and ensures that the wire 499 is not bent to an unacceptable small radius, to prevent damage to wire 499.

Figure 56:
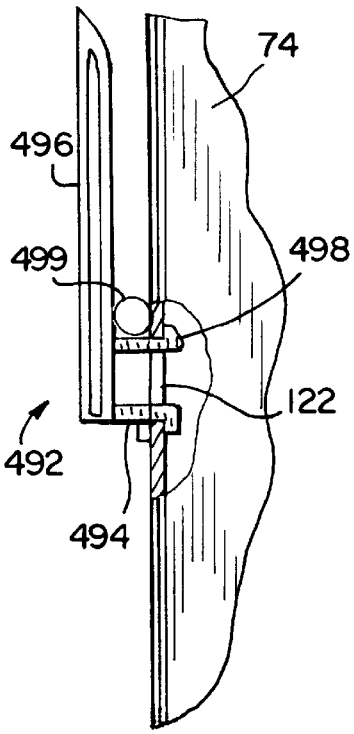
FIG. 56 is a partial section view sharing a wire support clip for use in the space dividing or partitioning system of the present invention.

The wire 499 is supported on post section 74 by a series of wire guides 492, as shown in FIGS. 50*b* and 56. As best seen in FIG. 56, the wire guide 492 includes an attachment section 494 joined to a depending flexible body 496. The attachment section 494 is pressed through one of the support slots 122 formed in the full post section 74. Expanded ends 498 of the attachment section 494 are biased outward and engage the inner surface of the full post section 74 to securely hold the wire guide 492 in place. The flexible body 496 is spaced from the outer wall of post section 74 to define a channel to receive and support wire 499. Wire guide 492 is received in the space between adjacent tiles 68, and functions both to support wire 499 from components being mounted to post section 74.

Figure 57:
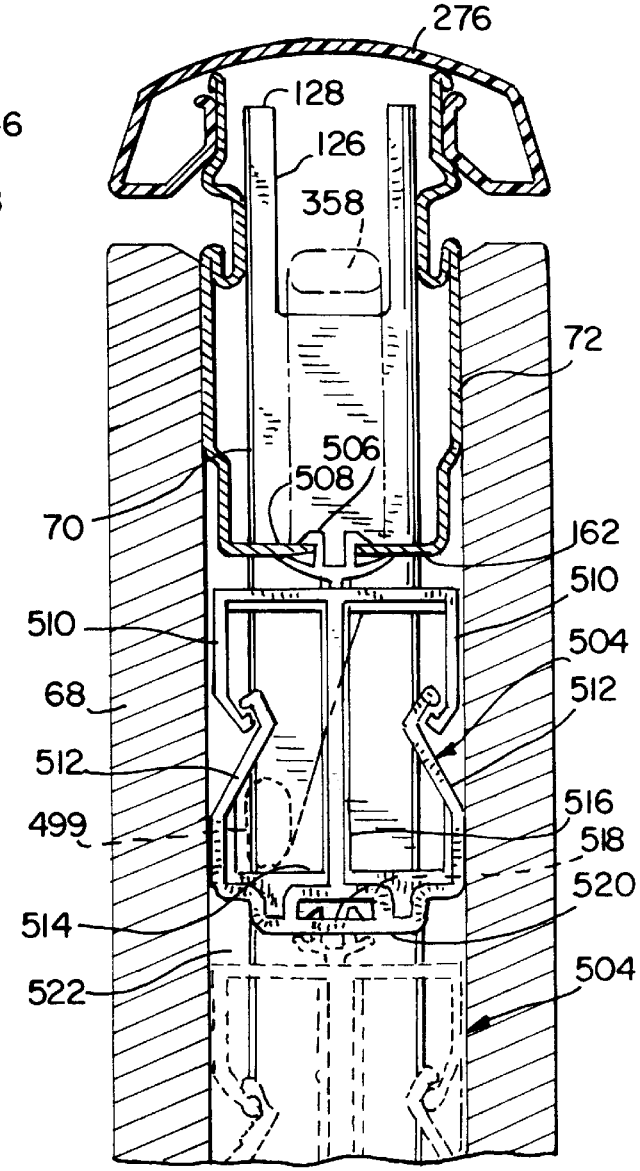
FIG. 57 is a partial section view illustrating a pair of wire clips attached to one of the horizontal support members of the system of FIG. 1.

Although the electrical connections for the space dividing or partitioning system 60 have been discussed as passing through the wireway 446 contained near the bottom of each panel 64, other wires such as 499 may also pass be at upper locations to provide voice or data to various locations along each of the panels 64 if desired. As shown in FIG. 57, as the wire passes upward between the horizontal support members 72, one or more wire support clips 504 retain the wire 499. The wire support clips 504 include an expanded head 506 that passes through an opening 508 formed in the bottom wall 162 of the horizontal support member 72. The wire support clips 504 include a first pair of arms 510 and a second pair of arms 512. Arms 510, 512 define overlapping ends that are slightly spaced apart from each other. A wire such as 499 is supported by each support clip 504 by pressing lower arm 512 inwardly an amount sufficient to enable wire 358 to pass through an opening defined between the overlapping ends of arms 510, 512. Wire 358 is then moved upwardly therethrough and inwardly out of engagement with lower arm 512, which returns to its original position as shown in FIG. 57. Wire 358 has been moved downwardly into the internal space defined by support clip 504, which includes a lower support surface 514 which is adapted to support wires such as 358.

A simple web 516 is disposed between the pairs of arms 510, 512, and is operable to maintain separation of wires such as 358 which may be engaged with the opposite sides of a wire support clip 504.

In addition, several wire support clips 504 can be ganged together as shown in FIG. 57, so as to accommodate passage of as many wires or cables as desired. Each wire support clip 504 includes an opening 518 in a lower wall 520, which is adapted to receive the expanded head 506 of a support clip 504 therebelow.

The mounting of tiles 68 to vertical posts 70 as shown and described defines a space, such as shown at 522, between the outer face of each post 70 and the inner, facing surface of each tile 68. In this manner, wires such as 358 can be passed through the space such as 522, such that wires 358 can pass freely between adjacent panel sections.

Figure 27:
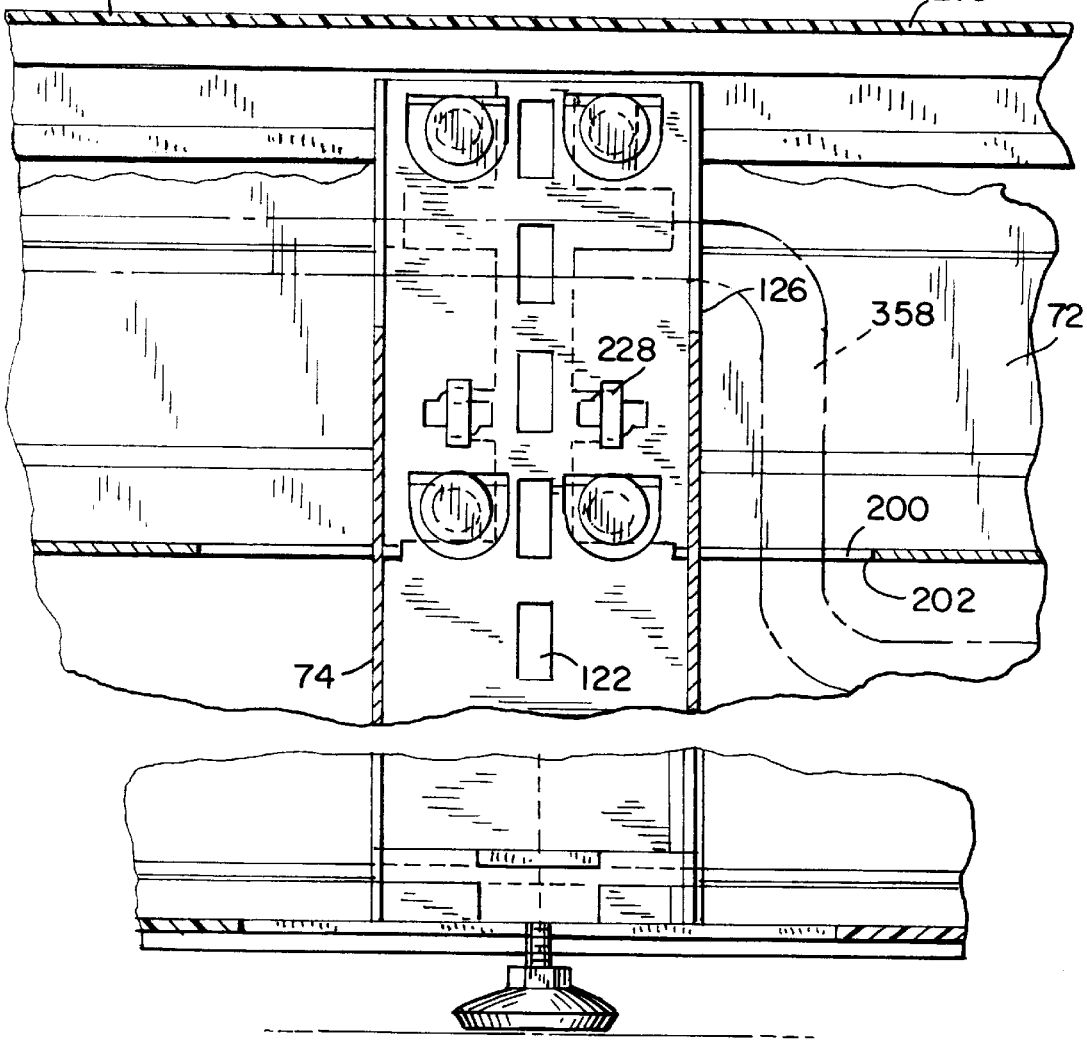
FIG. 27 is a partial section view taken along line 27—27 of FIG. 26.

Upon reaching one of the horizontal support members 72, the wire 358 passes through the cut-out 200 formed in the bottom wall 162 of the horizontal support member 72, as best shown in FIG. 29. As can be seen in FIG. 29, the size of the cut-out 200 is larger than the size of the wire 358, such that the wire 358 can pass through the open area between the curved edge 202 and the edge surface 124 of the full post section 74. Upon reaching the top of one of the vertical posts 70, the wire 358 can pass through the access notch 126 contained in either the full post section 74 or the half post section 78, as shown in FIGS. 27 and 57. Thus, wire 358 can pass through the vertical posts below the top end 128 and into the channel defined by horizontal support member 72, and be covered by the panel top cap 276.

Although not shown in the figures, it is contemplated that a horizontal support member 72 could be mounted between the vertical posts 70 at an intermediate location corresponding generally to the height of a conventional desk. With the horizontal support member 72 positioned as such, electric power and data connections can then be routed to the desk top level. This type of configuration can be constructed by simply mounting a horizontal support member 72 between the vertical posts 70 at the desired location, without any additional steps being taken or the complete disassembly of already assembled panel frames 66.

Although not illustrated in the drawings, it is contemplated that a conventional cover will be applied to vertical posts 70 between the edges of adjacent tiles 68, so as to conceal support slots 122.

Although only a few possible configurations for the space dividing and partitioning system 60 of the present invention have been shown and described in the figures, it is easily understood that the number of possible configurations for the system 60 depends only upon the imagination and requirements of the user. As can be understood, the space dividing and partitioning system 60 includes only relatively few parts that can be used interchangeably to form and connect panels in numerous configurations. Thus, the business or office owner only needs to stock a limited number of different components to be able to knock down and reconfigure an open office space.

Various alternatives and embodiments are contemplated as being within the scope of the following claims particularly pointing out and distinctly claiming the subject matter regarded as the invention.

What is claimed is:

1. A panel for use in a configurable panel system in which a plurality of panels are interconnected to subdivide an open workspace, the panel comprising:

a pair of spaced upright posts positioned to define the width of the panel;

at least one transverse support member interconnected between the pair of upright posts such that the pair of upright posts and the transverse support member define a panel frame;

one or more tile retaining members; and one or more tile members, each of which has a front face surface and a back mounting surface, wherein the back mounting surface includes receiving structure for receiving a tile retaining member;

wherein the tile retaining members are separate from the posts, the support members and the tile members, and wherein at least one of the posts and the support members include mounting structure for mounting the tile retaining members thereto, wherein each tile retaining member is adapted to engage the receiving structure of one of the tile members to support the tile member on the panel frame.

2. The panel of claim 1 wherein the transverse support member includes an access opening, the access opening being aligned with an opening in one of the posts when the transverse support member is attached to the post, and wherein the tile retaining members comprise tile retaining hooks, wherein one of the tile retaining hooks passes through the access opening and into engagement with the mounting structure.

3. The panel of claim 1 wherein the mounting structure comprises one or more openings formed in the upright posts.

4. The panel of claim 1 wherein each panel frame includes an upper transverse support member and a lower transverse support member connected between the pair of upright posts.

5. The panel of claim 1 wherein the transverse support member is generally U-shaped and is defined by a bottom wall and a pair of opposed sidewalls extending from the bottom wall, such that the pair of sidewalls and the bottom wall define a generally open interior.

6. The panel of claim 5 wherein each sidewall of the transverse support member includes a channel extending along the length of the transverse support member between a first end and a second end of the transverse support member.

7. A panel for use in a configurable panel system in which a plurality of panels are interconnected to subdivide an open workspace, the panel comprising:

a pair of spaced upright posts positioned to define the width of the panel;

at least one transverse support member interconnected between the pair of upright posts such that the pair of upright posts and the transverse support member define a panel frame;

a plurality of tile retaining members engageable with the panel frame; and a tile member having a front face surface and a back mounting surface, the back mounting surface including structure for receiving the tile retaining members to support the tile member on the panel frame, wherein the structure for receiving the tile retaining members includes a plurality of channels in the tile member positioned such that the tile member can be mounted to the panel frame in a first orientation and a second orientation rotated 90 degrees from the first orientation.

8. The panel of claim 7 further comprising an intermediate transverse support member connectable to each panel frame, wherein the intermediate transverse support member can be connected between the upright posts after the panel frame has been constructed without movement of the upright posts.

9. A panel for use in a configurable panel system in which a plurality of panels are interconnected to subdivide an open workspace, the panel comprising:

a pair of spaced upright posts positioned to define the width of the panel;

at least one transverse support member interconnected between the pair of upright posts such that the pair of upright posts and the transverse support member define a panel frame;

a plurality of tile retaining members engageable with the panel frame; and a tile member having a front face surface and a back mounting surface, the back mounting surface including structure for receiving the tile retaining members to support the tile member on the panel frame;

wherein each of the upright posts includes a front face surface and a rear face surface, wherein a series of spaced receptacles extend outward from each of the front and rear face surfaces.

10. The panel of claim 9 wherein each of the transverse support members extends between a first end and a second end, each of the first and second ends including at least a pair of attachment members extending therefrom, wherein when the transverse support member is positioned between the pair of upright posts, the attachment members are each received in one of the receptacles extending from the front and rear face surfaces of the upright posts.

11. The panel of claim 10 wherein the pair of attachment members contained on the first end and second end of the transverse support member are received in receptacles formed on opposite face surfaces of the upright post.

12. A panel for use in a configurable panel system in which a plurality of panels are interconnected to subdivide an open space, the panel comprising:

a pair of spaced upright posts positioned to define the width of the panel;

at least one transverse support member interconnected between the pair of upright posts such that the pair of upright posts and the transverse support member define a panel frame, the transverse support member extending between a first end and a second end, wherein the transverse support member can be mounted between the upright posts when the upright posts are spaced a distance less than the length of the transverse support member between its first end and second end;

wherein each upright post includes a front face surface and a rear face surface, each of the front and rear face surfaces including a series of spaced receptacles extending outwardly therefrom.

13. The panel of claim 12 wherein each of the first and second ends includes a plurality of attachment members, the attachment members being received and retained in the receptacles formed on the upright posts.

14. The panel of claim 12 wherein the receptacles are evenly spaced along substantially the entire length of each upright post.

15. The panel of claim 13 wherein the panel frame includes an upper transverse support member and a lower transverse support member connected between the pair of upright posts.

16. The panel of claim 15 further comprising an intermediate transverse support member connectable to the panel frame at a selected location between the upper transverse support member and the lower transverse support member, wherein the intermediate transverse support member can be connected to the panel frame without separating the upright posts.

17. The panel of claim 16 wherein each transverse support member is generally U-shaped and is defined by a lateral wall and a pair of opposed sidewalls extending from the lateral wall, such that the pair of sidewalls and the lateral wall define a generally open interior, wherein the lower transverse support member is inverted relative to the upper transverse support member.

18. The panel of claim 17 wherein each sidewall of the transverse support members includes a channel extending along the entire length of the transverse support member.

* * * * *

UNITED STATES PATENT AND TRADEMARK OFFICE

CERTIFICATE OF CORRECTION

PATENT NO. : 6,115,977
DATED : September 12, 2000
INVENTOR(S) : Timothy G. Hornberger, et al.

It is certified that error appears in the above-identified patent and that said Letters Patent is hereby corrected as shown below:

On the title page,

[75] Inventors: Delete "Andrew W. Mansfield" and substitute therefor -- Andrew Mansfield --.

IN THE CLAIMS

CLAIM 8, column 24, line 6, delete "7" and substitute therefor -- 4 --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*